US012773612B2

(12) United States Patent
Barrowcliffe

(10) Patent No.: US 12,773,612 B2
(45) Date of Patent: Oct. 27, 2026

(54) GOLF TRAINING DEVICE AND SYSTEMS THEREOF

(71) Applicant: Spineline Golf Pty Ltd, South Melbourne (AU)

(72) Inventor: Michael Philip Barrowcliffe, San Remo (AU)

(73) Assignee: Spineline Golf Pty Ltd, South Melbourne (AU)

( * ) Notice: Subject to any disclaimer, the term of this patent is extended or adjusted under 35 U.S.C. 154(b) by 431 days.

(21) Appl. No.: 18/143,040

(22) Filed: May 3, 2023

(65) Prior Publication Data

US 2023/0271074 A1 Aug. 31, 2023

Related U.S. Application Data

(63) Continuation-in-part of application No. PCT/AU2022/050168, filed on Mar. 2, 2022.

(51) Int. Cl.
*A63B 69/36* (2006.01)
*A63B 71/06* (2006.01)

(52) U.S. Cl.
CPC ..... *A63B 69/3608* (2013.01); *A63B 71/06* (2013.01); *A63B 2071/0694* (2013.01); *A63B 2209/08* (2013.01); *A63B 2225/74* (2020.08)

(58) Field of Classification Search
CPC ..... A63B 69/3608; A63B 71/06; A63B 2071/0694; A63B 2209/08; A63B 2225/74; A63B 2225/09; A63B 69/3621; A63B 2209/10
USPC ..... 473/207–209, 212, 215, 216, 257, 266, 473/274, 277; 482/10, 51, 109, 110
See application file for complete search history.

(56) References Cited

U.S. PATENT DOCUMENTS 4,456,257 A * 6/1984 Perkins ..... A63B 69/3608 473/220
4,971,325 A * 11/1990 Lipps ..... A63B 69/3608 473/209
5,685,782 A * 11/1997 Lipps ..... A63B 69/3608 473/220
5,800,278 A * 9/1998 Varriano ..... A63B 69/3608 473/224

(Continued)

OTHER PUBLICATIONS

International Search Report for Application No. PCT/AU2022/050168, dated Jul. 7, 2022, 4 pages.

(Continued)

*Primary Examiner* — Nini F Legesse
(74) *Attorney, Agent, or Firm* — Morgan, Lewis & Bockius LLP

(57) ABSTRACT

A golf stroke training apparatus is disclosed, comprising a light source attached to the chest of the golfer. Light shines towards a visible surface whereby observation of the light provides information about the movement of the chest. It can be deduced how the golfer generates movement of the club, with respect to elements such as rotation around the spine or movement at other joints, such as shoulders or hands. The apparatus can be particularly useful for putting but can also guide thoracic movement in other golf strokes. Optionally, a second device having a light source can be secured in relation to the pelvis of the golfer, for use separately or in concert with the chest mounted device.

14 Claims, 20 Drawing Sheets

(56) References Cited

U.S. PATENT DOCUMENTS

| | | | | |
|---|---|---|---|---|
| 6,939,245 | B1 * | 9/2005 | Mullarkey | A63B 69/3614 473/268 |
| 7,306,525 | B2 * | 12/2007 | Sawada | A63B 69/3608 473/212 |
| 9,144,728 | B1 | 9/2015 | Wachtler | |
| 9,295,896 | B1 * | 3/2016 | Hoang | A63B 71/0622 |
| 2007/0001106 | A1 * | 1/2007 | Schmidt | A63B 69/3632 250/221 |
| 2015/0148145 | A1 * | 5/2015 | Jeffrey | A63B 69/3608 473/266 |

OTHER PUBLICATIONS

Written Opinion of the International Searching Authority for Application No. PCT/AU2022/050168, dated Jul. 7, 2022, 8 pages.

* cited by examiner

GOLF TRAINING DEVICE AND SYSTEMS THEREOF

CROSS-REFERENCE TO RELATED APPLICATIONS

This application claims priority to and the benefit of International Patent Application No. PCT/AU2022/050168, filed on Mar. 2, 2022, which claims priority to Australian Patent Application No. 2021900669, filed on Mar. 9, 2021, and claims priority to and the benefit of Australian Patent Application No. 2022901153, filed on May 3, 2022, the entireties of each of which are hereby incorporated by reference.

BACKGROUND

Golf requires a coordinated swing or stroke to play a variety of shots. Part of the body movement required, for almost every shot, is a controlled rotation of the upper body around the axis of the upper part of the thoracic spine. In a full shot the lower body moves such that the base of the spine is also moved. However, for a short shot such as a putt, all that may be is required is a relatively slight rotation of the chest and limbs around the axis of the upper spine. Although the putting stroke appears simple, expert opinion about the correct method has varied over the years.

At the turn of the last century, golf authority Dave Pelz promoted a putting stroke that was relatively straight back and straight through, with the face of the putter being held directed towards the target throughout. This pattern of putter movement, as seen from above, is shown in FIG. 1. Although the face of the putter is aligned to the target as much as possible, apparently to many players the stroke feels unnatural and requires manipulation of the putter.

Since this time, the analysis of golf has improved with technologies such as video and computer imaging, and more recently systems such as SAM PuttLab, which uses ultrasound to measure and then display putter movements with extreme precision (https://www.scienceandmotion.com/puttlab/).

After much observation of elite golfers, golf authorities now recommend a different pattern of movement. As seen from above, the putter head should move on an arc, going inside the target line in the backswing and inside again in the follow through. Relative to the target, the putter face appears to open in the backswing and close in the forward swing. However, the putter face remains perpendicular to the path of the putter head. Critically, the putter face is square to the target line at the moment of impact. This pattern of movement is shown in FIG. 2 of the accompanying drawings.

Video camera analysis can also show a view from behind the golfer: the best putters are seen throughout the stroke to keep the shaft of the putter on the "plane" that is established at address. (The term plane is widely used in golf stroke analysis, being an imaginary flat surface along which the shaft of the club is seen to move from the perspective of an observer or camera behind the golfer in that plane).

This ideal pattern of movement can in theory be produced by a simple rotation of the upper body around the axis of the upper thoracic spine. The chest rotates whilst the shoulder blades (scapulae) stay in position on the posterior chest wall, so the shoulders and arms and hands are thus held in a constant position relative to the chest. Meanwhile the head and neck and lower body are kept very still. The upper spine in the chest must be the axis because it is in continuity with the spine in the neck.

However, it seems that many players find this technique difficult to apply. Potential reasons for this are discussed. Initially the analysis is how it might be difficult for the golfer to get in the right set up or posture, and the second part of the analysis is on the movement pattern.

Firstly, a rather obvious reason for failure might be an inability to correctly align the body, particularly the upper chest and spine. Golf is a game that is played generally with the body "square" to the target, which in anatomical terms means the frontal plane of the body should be aligned parallel to the intended path of the golf club, and effectively also parallel to the target line or "ball-to-target" line. This can be surprisingly difficult to achieve, even when close to the hole as when putting. This may be because the eyes are not able to be in line with the target.

There are also other more subtle reasons why the technique may fail, although the physics may not be immediately appreciated. When the golfer sets up to stroke the putt, if the angle of the thoracic spine in the sagittal plane is not matched to the angle of the putter shaft, the hands of the golfer will not move on the plane of the putter shaft when the torso turns around the spine. Line diagrams are used to explain this interaction, using average proportions for the body and putter.

FIG. 3 shows the ideal posture. The putter shaft has a typical "lie angle" of 70 degrees to the ground. The upper thoracic spine could be said to have a lie angle of 20 degrees, as shown by the dotted line angle. Note that the spine and putter shaft are perpendicular to each other, thus when the torso turns around the spine, the hands will move on the same plane as the putter shaft. The putter will move in an arc that is determined by both the height of the thoracic spine and the angle it makes with the ground. The face of the putter will naturally open and close throughout the stroke, with no manipulation needed to attempt to keep the face square to the path of the putter. Note also that there will be no unwanted rotational forces upon the putter that might be felt by the golfers' hands. It should be possible to feel in control of the putter head with a light grip (as elite players describe).

FIG. 4 shows a mismatch of angles of spine and putter shaft. The golfer has a bent posture so the spine is relatively flat compared to the putter shaft. The putter lie angle is 70 degrees, and the golfer could be said to have a spine lie angle of 10 degrees. When the torso turns around the spine, the hands will move on a more steeply vertical plane than the putter shaft.

FIG. 5 shows a mismatch of angles of spine and putter shaft, but this time the golfer has a more upright posture, so the upper thoracic spine is relatively vertical compared to the putter shaft. The spine has a lie angle of 30 degrees, and when turning around the spine the hands will move on a more horizontal plane than the putter shaft.

So a golfer may set up to make what looks like a relatively simple stroke, like a short putt. But if there is misalignment of the upper spine pivot, in one or other of the frontal or sagittal planes, it is likely that the stroke will be mechanically flawed. The golfer may well be able to move the putter on the correct path with an upper chest not well aligned in the frontal plane. The golfer may also move the putter on a specific plane, despite a posture where the upper chest and upper spine pivot is not appropriately aligned in the sagittal plane. However, in both these instances (which can co-exist) there will be manipulation of the putter by some means other than a simple rotation of the upper chest around the spine.

Thus far the problems facing the golfer could be summarized as having arisen because the golfer was not in the correct posture with the correct alignment. The second part of the problem is that golfers are very used to moving shoulders, arms and hands in other golf strokes, so these movements may be difficult to inhibit, especially for delicate short shots.

The putting stroke is often described as being essentially a rocking motion of the shoulders, with the arms and putter moving beneath the shoulders, as if a pendulum on a plane. This pattern of movement is apparently exactly what happens if the upper chest rotates around the upper spine, whilst the shoulders stay in constant relationship to the chest. As previously discussed, this appears to be the pattern of movement of elite putters. However, there is another pattern of movement that appears very similar, but potentially has a very different outcome. This is a rocking motion of the shoulders, but one generated by the sliding of the shoulder blades (scapulae) on the chest wall. This of course can be accompanied by some rotation of the chest. Note that it is likely difficult for both the individual making the movement, or an observer (even with a video camera) to discern if there is any additional movement of the shoulder blades (scapulae) on the chest wall. Also, movement of the upper arm in the shoulder joint is not easily discerned. Other sites of movement that may be undesired are generally easier to observe, such as at the hands/wrists and elbows.

Although the rocking motion of the shoulders is widely thought to be the basis of a good putting stroke, the two methods to achieve it, as just described, have quite different effects on the way the putter moves. Only with a stroke based upon rotation around the thoracic spine will the putter move on an arc defined by the spine position, with the putter face remaining square to the arc throughout (these being very desirable characteristics, as previously discussed). However, if a stroke is based upon a sliding movement of scapulae, which do not necessarily move synchronously, there is no rational reason for the putter to move in a particular arc, nor for the putter face to open and close with any defined relationship to the path of the putter.

Whilst various training aids are available to help develop a repeatable putting stroke, none seem based upon the anatomical characteristics of the golfer or take account of the mechanical issues described above.

Thus far, various training aids have focused on putting. This analysis reveals that what might look like the simplest part of the game can be quite complex, as many physical factors can interact. Psychological issues can develop as the putting stroke becomes unreliable. Many golfers, at all levels, find it frustrating and difficult. Some suffer enough to give up the game.

There are many examples of golf training devices in the prior art, most of which are aimed at either assisting the player in targeting the ball to the target or facilitating the best way to hit the ball (i.e., correct swing motion). One such example, is the device shown in European Patent Publication EP0427770, which describes a golf training device with a laser light generating mechanism within the grip of the training device which generates a laser light beam that projects out of the top of the grip. In this device the collimated light emitting from the grip provides the golfer with a precise line of light which is visible during the backswing and the downswing, giving the golfer feedback prior to impact with the ball which will enable the golfer to correct the swing before hitting the golf ball.

Another example is the devices proposed in United States Patent Publication US2014/0221116, which teaches a golf training club device with a light beam generator along the shaft that generates light beams directed towards inside and outside positions corresponding to the head and toe of the club head. The laser beam 28 traces a laser beam path 30 on the ground 32 as the golfer makes a swing.

Finally, International PCT Patent Publication WO2015118465 discloses a laser path guide that is intended to be attached to a glove worn by a user during a stroke. When wearing the glove training device, a golfer can take a stance with respect to one or more reference lines drawn on a practice surface, align a laser beam produced by the laser path guide to fall on a reference point drawn on the practice surface and then practice a golf swing. During the practice of the golf swing the laser beam should follow the reference lines drawn on the practice surface. A proper golf swing is produced when the laser beam follows the reference lines.

While the above prior art examples do each offer an interesting example of devices to assist a golfer in perfecting their stroke, the devices do not take into consideration the importance of the relative motion of the upper chest and spine during the stroke.

As such, there is benefit and rationale to improve the mechanics a golf stroke, and a novel apparatus and device to assist in doing so is described.

SUMMARY OF THE INVENTIONS

According to one aspect of the present disclosure there is provided a training apparatus, comprising: a support member with securing means adapted to be secured about the anterior aspect of a player's thorax, and a light source configured to provide a visual indication of the orientation of the player's thorax and rotation of the thorax about the axis of the thoracic spine during movement while making a real or simulated golf stroke;

wherein the light source comprises a collimated laser configured to project an alignment pattern onto a ground and/or wall surface in front of the player, in use; and wherein the alignment pattern comprises:

(i) at least one first laser line alignable with an intended target line; and (ii) at least one second laser line extending transverse to the at least one first laser line; wherein the at least one first and second laser lines of the alignment pattern form a T shape pattern.

Preferably, the alignment pattern is projected onto the ground at a location that is adjacent or proximal to the club head of the golf club held by the player during the stroke. Preferably, during a stroke the player observes the relative path of the light source on the ground surface with respect to the path of the club head.

Preferably, the support member comprises a light source attachment means. Preferably, the attachment means comprises a screw type or clamping connection means adapted to secure the light source to the support member. Preferably, the attachment means comprises a magnet configured to magnetically couple to the light source.

In accordance with some embodiments, the apparatus further comprises one or more shoulder straps, the shoulder straps adapted to be secured to the light support member to secure the support member about the shoulders of the player. Preferably, the shoulder straps are worn by the player and are attached to the support member, the support member rests substantially over the midline of the sternum. Preferably, the shoulder straps run posteriorly and attach to a back plate positioned in the midline of the back.

Optionally, the training apparatus comprises a vest or holster adapted to be worn by the player and wherein the support member is attached to the vest or holster.

Optionally, the attachment means is configured to secure the light source directly to the player's body.

Preferably, the attachment means further comprises an adjustment means adapted to alter the angle of the light from the light source relative to the housing. More preferably, the adjustment means is adapted to alter the angle of the light from the light source about the player's sagittal, coronal and transverse planes.

Preferably, the light source is a collimated beam. More preferably, the collimated beam is a laser.

Preferably, the training apparatus comprises one or more first laser lines that are substantially along the target or ball-to-target line and one or more second laser lines that are substantially transverse to the one or more first laser lines. Preferably, the one or more first laser lines are substantially transverse to the face of the club used by the player.

In some embodiments, the apparatus further comprises at least one visual aid adapted to provide a visual reference regarding motion of the light source during a stroke.

Preferably, the at least one visual aid comprises a first horizontal visual aid, wherein the first visual aid is placed on the ground surface in a position that is parallel to the ball-to-target line of the stroke. Preferably, the light source illuminates a laser line that is substantially parallel or on substantially top of the first visual aid when the player is making the stroke. Preferably, a second vertical visual aid that is supported in a vertical plane is provided.

In some embodiments, the attachment means is further configured to secure an elongated rigid rod or pointer thereto. Preferably, the elongated rod or pointer is adjustable in length.

In accordance with some embodiments of the present disclosure, golf stroke training apparatus is provided which comprises a light source adapted to be secured about the anterior aspect of a player's thorax, the light source being configured to provide a visual indication of the rotation of the player's thorax about the axis of the thoracic spine during a stroke.

Preferably, the light source is configured to indicate the accuracy of setup of the upper chest in the frontal plane and provide a means to distinguish an error in this regard from a tilt of the upper chest and upper spine.

Preferably, the light source illuminates a surface that is visible to the player when making the stroke. Preferably, the surface is the ground, a wall, the player's hands and/or arm or a combination thereof. Preferably, the light source illuminates the ground at a location that is adjacent or proximal to the club head of the golf club held by the player during the stroke. Preferably, the light source illuminates the ground surface and is visible to the player when standing in a stroke position. Preferably, the light source illuminates the ground surface adjacent or proximal to the player's club head. Preferably, during a stroke the player observes the relative path of the light source on the ground surface with respect to the path of the club head. Preferably, the path of the light source about the ground surface during the optimal rotation follows a path that is substantially parallel to that of the putter.

Preferably, the training aid comprises a light source support member adapted to secure the light source to the player. Preferably, the support member comprises a light source attachment means. Preferably, the attachment means comprises a screw type or clamping connection means adapted to secure the light source to the support member. Preferably, the attachment means comprises a magnet configured to magnetically couple to the light source.

In accordance with some embodiments, the apparatus further comprises one or more shoulder straps, the shoulder straps adapted to be secured to the light support member to secure the support member about the shoulders of the player. Preferably, the shoulder straps are worn by the player and are attached to the support member, the support member rests substantially over the midline of the sternum. Preferably, the shoulder straps run posteriorly and attach to a back plate positioned in the midline of the back.

Optionally, the training apparatus comprises a vest or holster adapted to be worn by the player and wherein the support member is attached to the vest or holster.

Optionally, the attachment means is configured to secure the light source directly to the player's body.

Preferably, the attachment means further comprises an adjustment means adapted to alter the angle of the light from the light source. More preferably, the adjustment means is adapted to alter the angle of the light from the light source about the player's sagittal, coronal and/or transverse planes.

Preferably, the light source is a collimated beam. More preferably, the collimated beam is a laser.

Preferably, the training apparatus comprises one or more first laser lines that are substantially along the ball-to-target line and one or more second laser lines that are substantially transverse to the one or more first laser lines. Preferably, the one or more first laser lines are substantially transverse to the face of the club used by the player. Preferably, the one or more first laser lines are adjusted to run along an axis that is substantially transverse to the player's chest and the one or more second laser lines run along the sagittal plane.

In some embodiments, the apparatus further comprises at least one visual aid adapted to provide a visual reference regarding motion of the light source during a stroke. Preferably, the at least one visual aid comprises a first horizontal visual aid, wherein the first visual aid is placed on the ground surface in a position that is parallel to the ball-to-target line of the stroke.

Preferably, the light source illuminates a laser line that is substantially parallel or on substantially top of the first visual aid when the player is making the stroke. Preferably, a second vertical visual aid that is supported in a vertical plane is provided.

In some embodiments, the attachment means is further configured to secure an elongated rigid rod or pointer thereto. Preferably, the elongated rod or pointer is adjustable in length.

In another aspect, the present disclosure provides a golf training apparatus comprising: a support member with securing means adapted to be secured about a player's waist to fix the support member, in use, in relation to the player's pelvis, and a light source configured to provide a visual indication of the orientation of the player's pelvis during movement while making a real or simulated golf stroke;

wherein the light source comprises a collimated laser configured to project an alignment pattern onto a ground and/or wall surface in front of the player, in use; and wherein the alignment pattern comprises:

(i) at least one first laser line alignable with an intended target line; and (ii) at least one second laser line extending transverse to the at least one first laser line;

wherein the at least one first and second laser lines of the alignment pattern form a T shape pattern.

Preferably, during a stroke the player observes the movement or lack of movement of the light pattern on the surface during stroke.

Preferably, the one or more laser lines provide a visual indication of the orientation and movement of the pelvis.

Preferably, the apparatus further comprises a rigid plate that is attached to either end of the adjustable belt, wherein in use the rigid plate rests directly over the sacro-iliac area of the posterior part of the pelvis. Preferably, the rigid plate member comprises an attachment means adapted to secure the light source to the belt.

Preferably, the training apparatus further comprises a flexible elongated guide arm having a first and second end, wherein the first end is adapted to be secured via the attachment means on the rigid plate member and the second end is adapted to secure the light source thereto.

In another aspect of the present disclosure, a golf training system is provided that comprises a first device adapted to be secured about a player's waist, the first device comprising a first light source configured to illuminate a pattern on a surface that is visible to the player when making the stroke and a second device adapted to be secured about the anterior aspect of a player's thorax, the second device comprising a second light source configured to illuminate a pattern on a surface that is visible to the player when making the stroke.

Preferably, during a real or simulated golf stroke the first light source provides a visual indication of the orientation and movement of the player's pelvis and wherein the second light source concurrently provides a visual indication of orientation and movement of the thorax about the axis of the thoracic spine.

Preferably, the first device comprises an adjustable belt attached to the first light source and wherein the belt is configured to be secured at a position preferably below the iliac crests.

Preferably, the first and second device each further comprise a light source attachment means adapted to secure the light source to the respective device. Preferably, the attachment means comprises a screw type or clamping connection means adapted to secure the light source to its respective device. Preferably, the attachment means further comprises an adjustment means adapted to alter the angle of the emitted light from the light source.

Preferably, the first and second light sources are a collimated light source. Preferably, the collimated light source is a laser. Preferably, the lasers of the first and second light sources are different colours.

BRIEF DESCRIPTION OF THE DRAWINGS

Various features of illustrative embodiments of the inventions are described below with reference to the drawings. The illustrated embodiments are intended to illustrate, but not to limit, the inventions. The drawings contain the following figures.

DETAILED DESCRIPTION

Throughout the present specification, reference will be made to various body, club positions and lines on which the light source may move when in use. A concept referred to as ball-to-target line will be referenced, which is familiar to golfers and those skilled in the art. It is an imaginary line coming back from where it is intended the ball should start when it is struck, extending either side of the ball. This may not be where the ball may ultimately come to rest, especially for a putt on a sloping green, thus the hole may not be the target. The clubface will be orientated at 90 degrees to the ball-to-target line (also expressed as transverse or perpendicular or at a right angle).

Disclosed herein are devices and methods for golf stroke training. A first device is adapted to be secured at or around the player's sternum to illustrate alignment and movement of the chest. A second device is adapted to be secured about the player's waist to provide a visual indication of the orientation and movement of the pelvis. The first and second devices may be used individually, or in combination.

Figure 6:
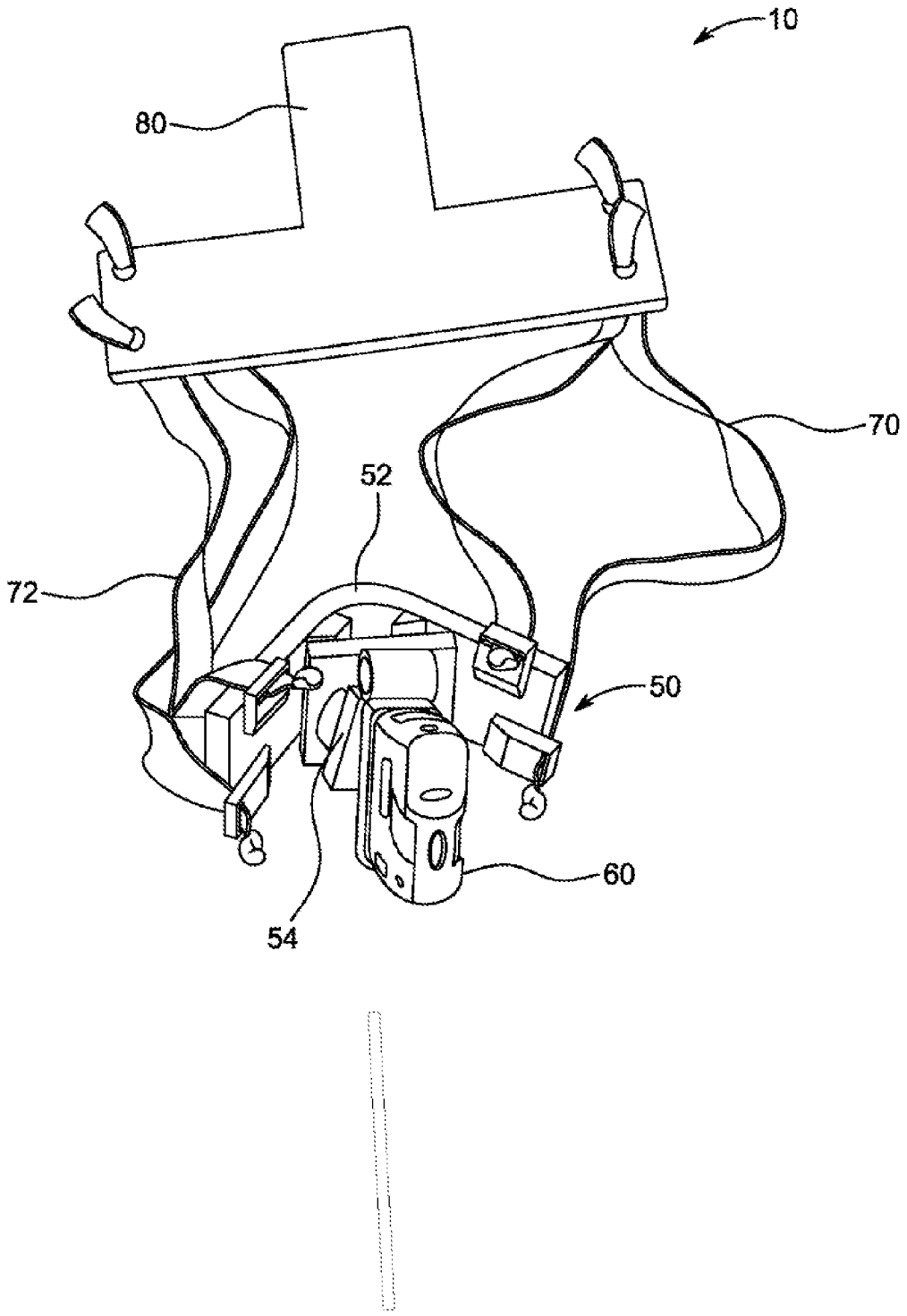
FIG. 6 shows the training apparatus, adapted for mounting in relation to a user's thorax, in accordance with some embodiments.
Figure 7:
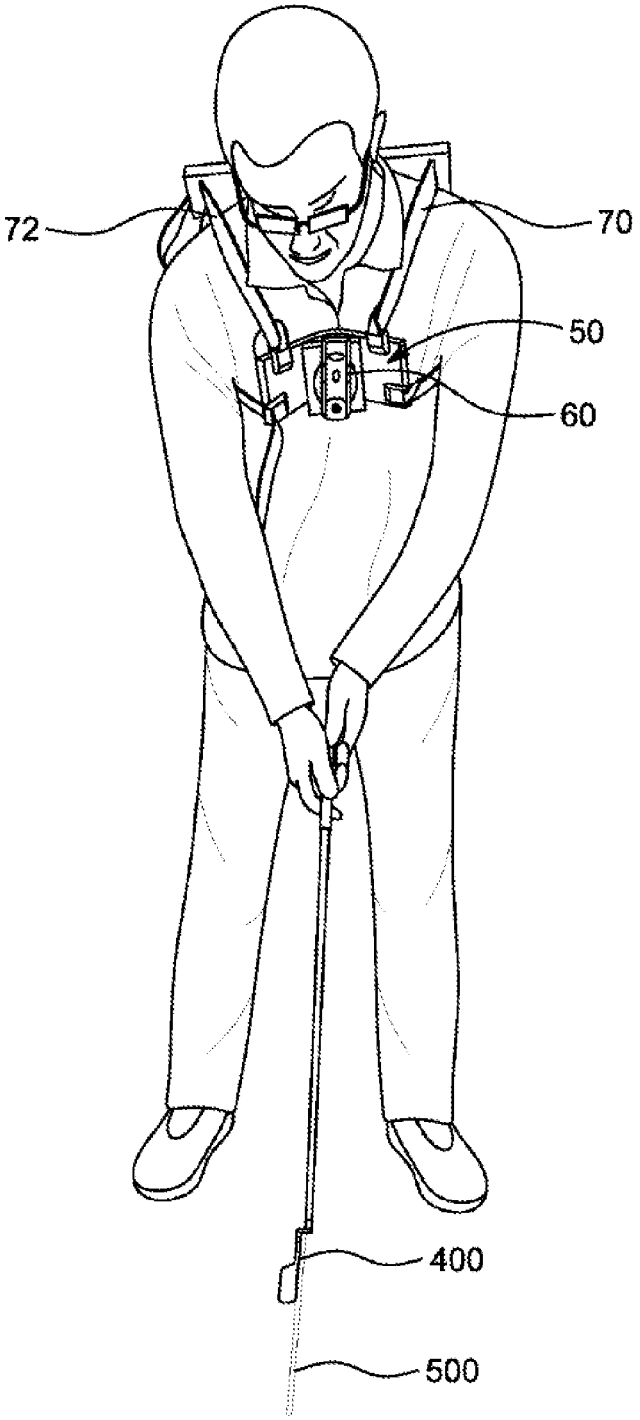
FIG. 7 shows a front view of a player wearing the training apparatus of FIG. 6, in accordance with some embodiments.
Figure 13:
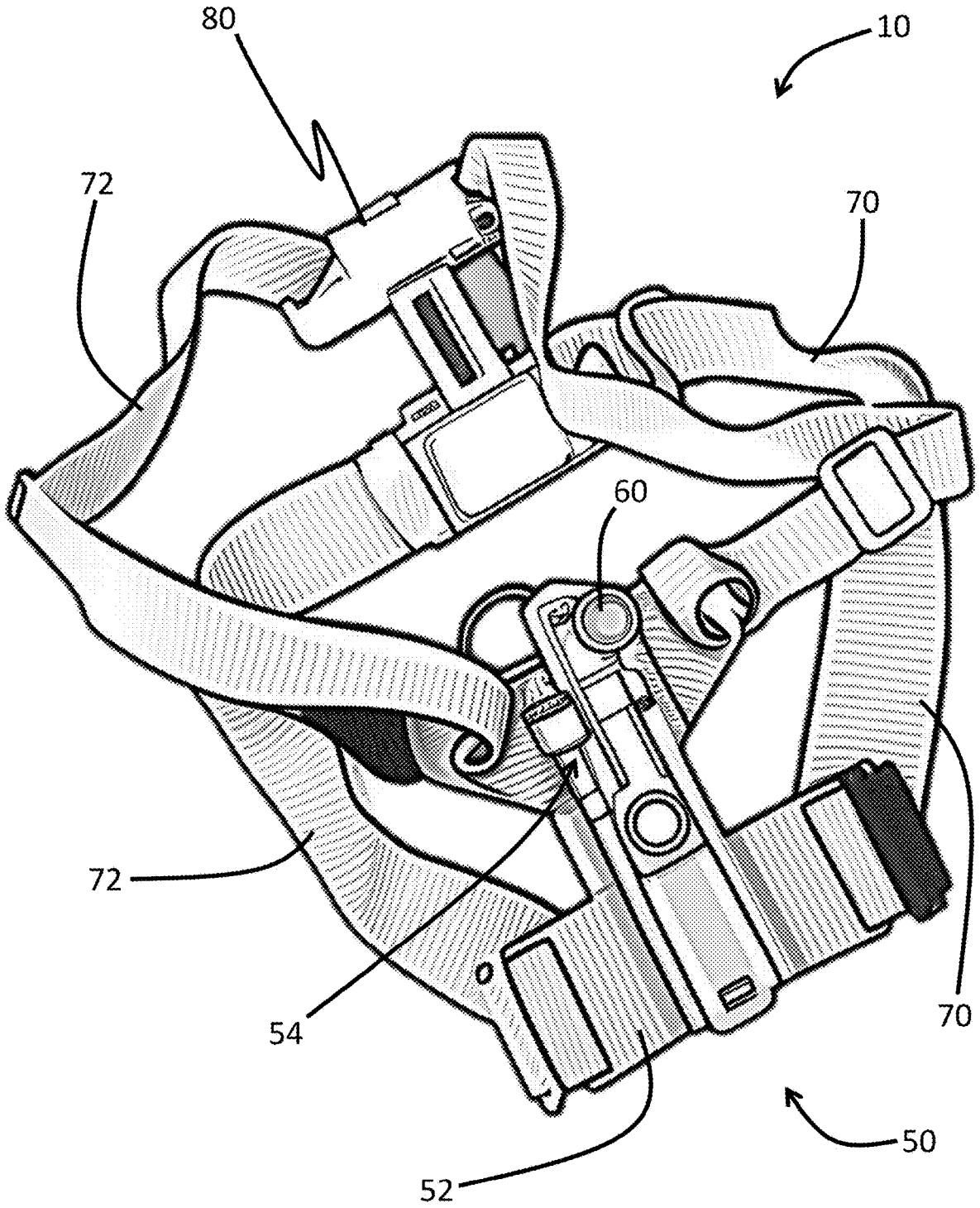
FIG. 13 shows another embodiment of the training apparatus, adapted for mounting in relation to a user's thorax.
Figure 14:
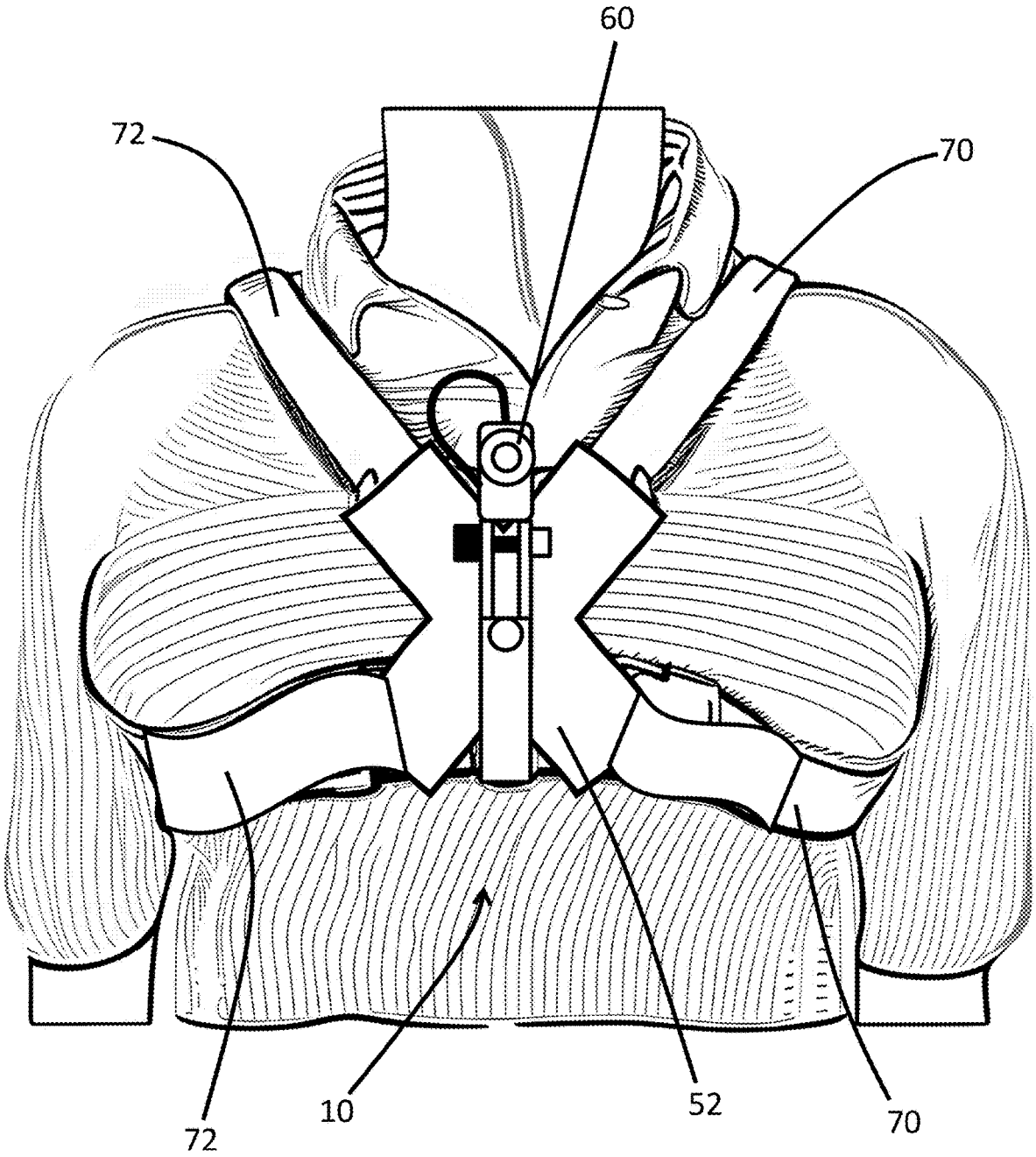
FIG. 14 is a front view of a user fitted with a chest mounted training device according to FIG. 13.

FIGS. 6 and 13 show variations of a golf stroke training apparatus 10 according to some embodiments. The training apparatus 10 comprises a light source support member 50 that is adapted to be supported about the players shoulder region by one or more shoulder straps 70, 72. The shoulder straps 70, 72 secure the support member 50 around the players shoulder region, whereby the support member rests substantially over the midline of the sternum, which is best shown in FIG. 7. The shoulder straps run posteriorly where they also connect with a rigid back plate 80 which is to be positioned in the midline of the back, over the spines of the upper thoracic vertebrae. FIG. 14 shows the training apparatus 10 of FIG. 13, when fitted to a player for use.

Figure 8:
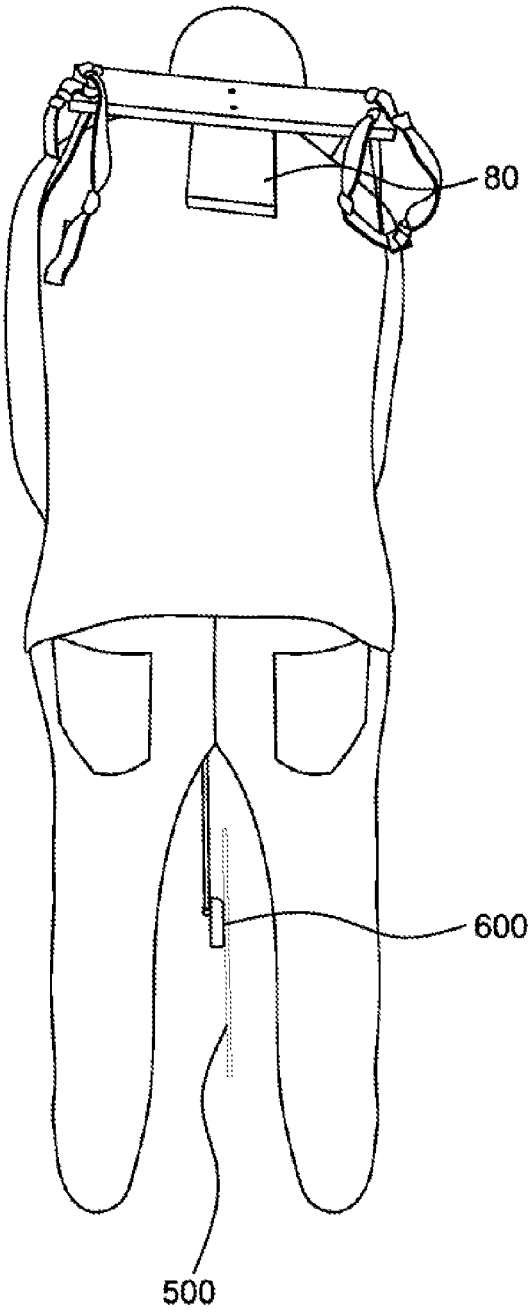
FIG. 8 shows a back view of a player wearing the training apparatus of FIG. 6, in accordance with some embodiments.

As is shown in FIG. 8, in use the back plate 80 is held tightly against the skin of the upper back and preferably in the midline between the scapulae. The back plate 80 overlies the spines of approximately the 2nd to 7th thoracic vertebrae, so the plate is parallel to these vertebral bodies.

While it is illustrated that shoulder straps 70, 72 and a back plate 80 can be used to provide adequate support for the wearable support member 50, one or more chest straps could alternatively be used to achieve the same purpose. It should be appreciated, however, that the wearable support member (50) when in use should lie in a region that follows the rotation of the player's thorax about the axis of the thoracic spine when making a stroke.

In some embodiments, the wearable support member 50 could be attached to a specially designed garment that is worn by the player, such as a shirt, vest or holster. In some embodiments, it is envisaged that the support member 50 would be secured to the front of the garment via a suitable attachment means. Alternatively, the support member maybe incorporated as part of the wearable garment itself as a single wearable item or be attached to the player's skin directly by using a suitable connection.

Importantly, the light source support member 50 may in fact be supported at a position that is substantially over the midline of the sternum using various alternative means without departing from the scope of the disclosure and thus is not overly limited. The important consideration is that the support member provides a rigid attachment for the light source 60 which will be described in further detail below.

Figure 9:
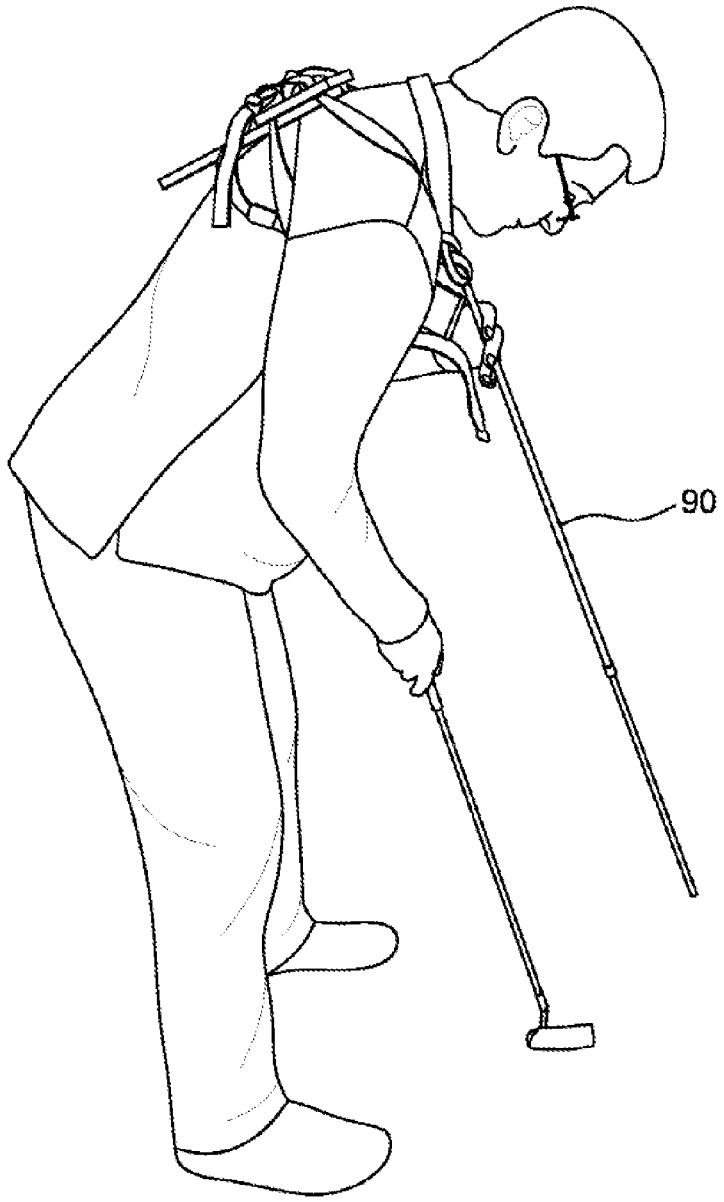
FIG. 9 shown a side view of a player wearing the chest mounted training apparatus, along with a rod or pointer element, in accordance with some embodiments.

As is shown in FIG. 9, the support member 50 can optionally be configured to provide an attachment for an elongated rod or pointer 90. This attachment can be made either in conjunction with the light source or in isolation thereof. Preferably, the elongated rod or pointer 90 is fabricated from a rigid, low weight material and has an adjustable length. For example, a telescopic rod may be used that enables the user to adjust the length of the rod between various lengths. That said, it is not a requirement for the elongated rod or pointer to be adjustable and some embodiments may be provided with a number of different rod sizes in a kit form.

The use of the elongated rod or pointer 90 facilitates the player to get the support member at an approximate right angle to the back plate 80, so that the golfer knows that when light source is added to the device the light emanates off the thorax at right angles to the upper thoracic spine. Secondly, the use of the pointer allows the player check that the putter shaft is parallel to the pointer.

As is best shown in FIG. 9, the angle of the elongated rod or pointer 90 has been adjusted so that it can be seen to be perpendicular to the back plate. The elongated rod or pointer 90 is also parallel to the shaft of the putter. This gives visual confirmation that there is optimal matching of the angles of the spine and the putter shaft, in this posture. This permits a putter to be "fitted" to the golfer, who can better develop or use a putting stroke based upon thoracic spine rotation.

In the illustrated embodiment, the support member 50 is shown to comprise a rigid body 52 that secures a light source 60 thereto. While not shown in detail in the Figures, the light source 60 is removably attached to the support member 50 via a suitable attachment means 54. The structure and type of the attachment means for the light source is not overly limited and is merely intended to adequately secure the light source 60. In some embodiments, however, the attachment means is a screw type connection that fastens the light source 60 or a clamping mechanism that clasps the light source to wearable support member. Other suitable attachment mean would include, but not be limited to, magnets or Velcro™.

As is shown in Figures, the light source 60 is a collimated light source such as a laser. While a laser is preferred as it offers good visibility in various light conditions, the type of light source used in the present disclosure is not overly limited and could be any light source that is capable of producing a pattern of one or more lines on the ground surface near the players club or putter head. To enhance interpretation, a pattern or one or more lines would be preferred.

It is preferable that the light source produces a pattern that is visible to the player in all indoor and outdoor light conditions, and thus has sufficient intensity. The pattern produced by the laser could be a grid or cross, whereby the laser is configured to produce a line on the ground that is substantially along or parallel to the ball-to-target line. In some embodiments, one or more first lines of the grid or cross pattern produced by the laser 60 on the ground surface would be aligned substantially parallel to the ball-to-target line, which is commonly referred to as the "target line" Consequently, one or more second lines of the grid or cross pattern produced by the laser 60 on the ground surface would be equal to or substantially parallel to the club face, or in other words, transverse to the one or more first lines. In the embodiment shown in FIGS. 7 and 8, a single laser line 500 is formed on the ground adjacent to the club head, where it is shown to be set up to be substantially parallel to the face of the club face 600.

While in some embodiments the light source can produce a pattern on the ground surface, in some embodiments, the laser may be guided to be incident upon the forearms or hands of the user. In this embodiment, the player during a putting stroke, for example, can monitor any unwanted movement outside of the preferred isolated rotation of the thoracic spine. In a more forceful stroke, the player may wish to allow and observe some additional movement and the timing of this to the chest rotation.

The attachment means 54 of the support member 50 permits the coach or player to adjust or pivot the direction of the light source. It is preferred that the light source is adjusted to illuminate the ground surface adjacent or proximal to the player's club head and is visible to the player. This allows the player to not only clearly visualize the light source on the ground during a stroke but also permit the player to retain good eye contact with the ball being struck.

In some embodiments, the attachment means permits the player to adjust the direction of the light source. Golf is a game in which the player is almost always side on or substantially at 90 degrees to the intended line of play. It is generally desirable for the player to be aware of their orientation in this regard. For this purpose, the first laser line can be adjusted so that dependent upon the posture of the player, the light from the laser may be displayed upon a wall or the ground. So, if the player stands directly facing a wall, the wall being parallel to the target line, the first laser line will be horizontal on the wall, and parallel to the ball target line if the laser is depressed in the sagittal plane, or the golfer simply bends at the hips to assume a posture for a golf stroke. Under the same circumstances, the second line (being at 90 degrees to the first) will be a vertical line if on the wall, or if on the ground it will be a line beneath the upper spine.

In use and when setting up to make a stroke during training, especially for putting, a player will align the one or more first laser lines to be substantially parallel to the ball-to-target line. If the first line of the laser is set to project from the chest at 90 degrees to the upper spine in the sagittal plane, then during a stroke which is based upon rotation of the chest around this spinal axis, the first line will move backwards and forwards on the same line parallel to the ball target line, at a certain distance away from the golfer. However, if the laser is not at 90 degrees, but say only at 70 degrees to the spine (so that the first line is now closer to the players' feet), then with thoracic spine rotation the first line will move in an ellipse concave towards the players' feet.

Also, during the stroke the player will observe the relevant motion of the one or more first lines to the club head, whereby the one or more first lines should remain moving synchronously with the club head. This would be a visual indication noting spine rotation is the primary source of movement.

The one or more second lines illuminated by the light source when a player makes a stroke can shine on the putter and other parts such as the putter grip, hands or arms. If the line or lines do not stay in position throughout the stroke, this indicates additional movement sources are present. This is an important function of the device, especially for putting. Additionally, the one or more second laser lines that are transverse to the target line provides a visual guide to how the putter face should open and close throughout the stroke. With a stroke based on spine rotation this should occur naturally, and not require manipulation, for example, by the hands. Comparison of these one or more second laser lines and the leading edge of the putter may reveal this manipulation, with or without movement at additional sites such as the shoulders. Note that for the above functions of the second laser line, it does not matter what is the setting of the laser to the upper spine in the sagittal plane.

The one or more second laser lines are set to be substantially transverse to the one or more first laser lines. In this manner and as is best shown in FIGS. 7 and 8, the one or more second laser lines are set to be parallel to the club face. Once again, it should be noted that FIGS. 7 and 8 show just one embodiment whereby a single laser line is provided that is substantially parallel to the club face.

With respect to the above it should be appreciated that relative movement of the light source on the ground is easier to visualise when using a club. However, it is not a requirement for the player to use a club when using the training apparatus. The apparatus provides a simple and easy to use mechanism to monitor the rotation of the player's thorax about the axis of the thoracic spine. It allows the player to significantly enhance their movement during a stroke and thus significantly improve the accuracy of their game on the course.

In some embodiments, one or more visual aids are provided and used with the golf stroke training apparatus. The visual aids facilitate the player to easily monitor and observe the motion of the light source during a stroke. In particular, the visual aids provide a quick visual reference of the movement of the light source and thus in some instances make it significantly easier for the player to identify correct rotation about the thoracic spine that occurs during the stroke.

Figure 10:
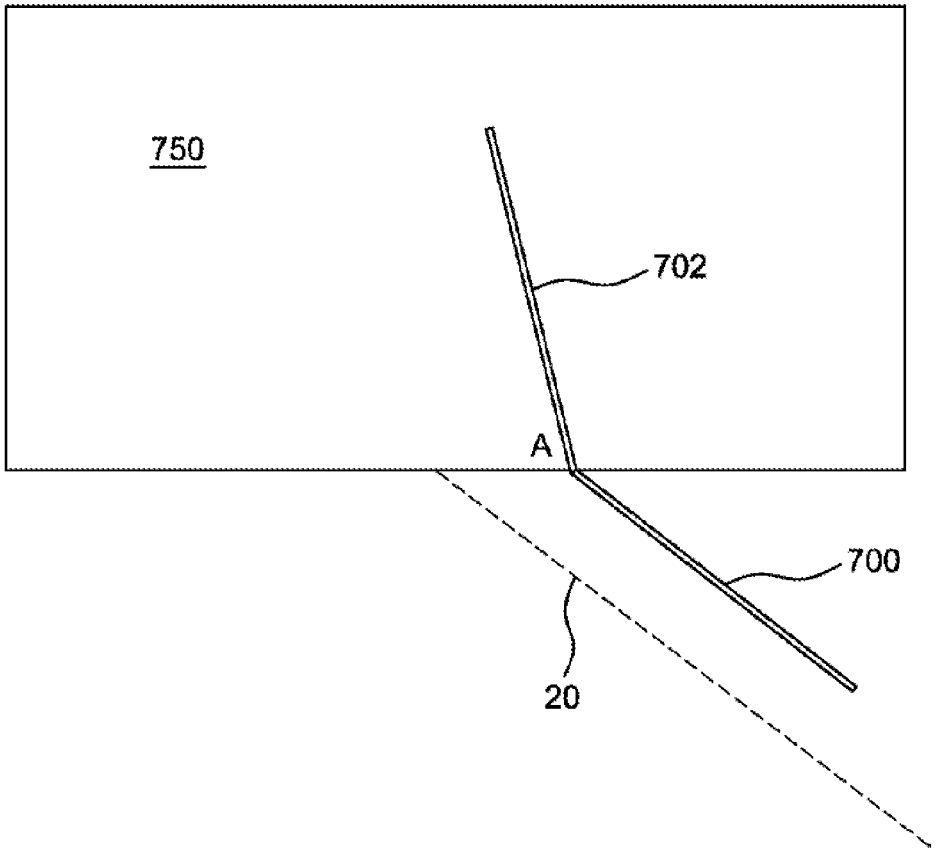
FIG. 10 shows a representation of the visual aids used in conjunction with golf stroke training apparatus, in accordance with some embodiments.

As shown in FIG. 10, this embodiment includes a first horizontal visual aid 700 and a second vertical visual aid 702. The visual aids (700) and (702) may be used in combination with each other or in isolation, however, they are intended to be used in conjunction with the wearable light source that has been described in more detail in the preceding paragraphs of the present specification.

Figure 1:
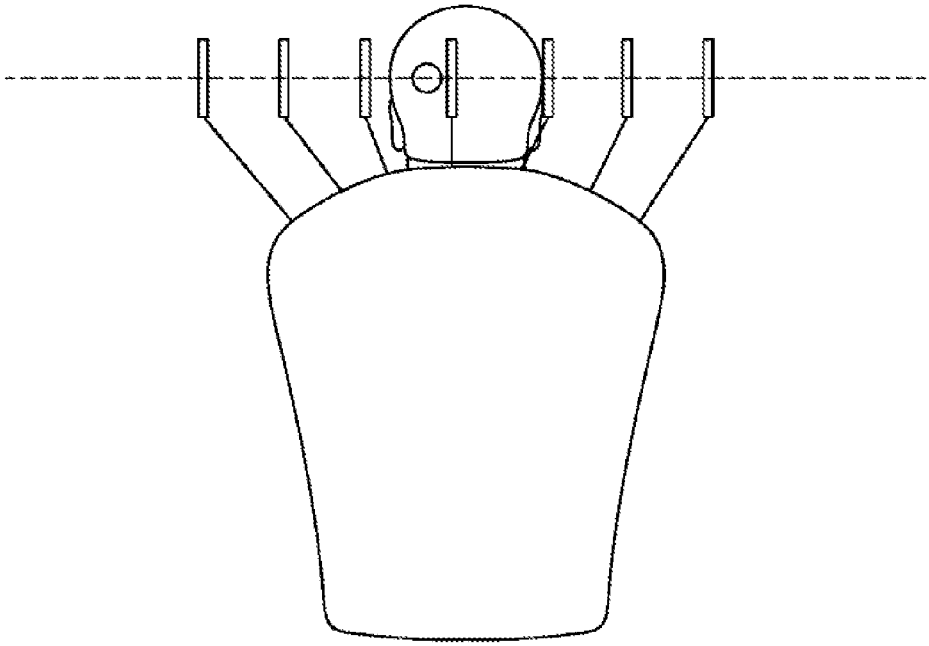
FIG. 1 shows a top view of a straight back straight through style of putting stroke.
Figure 2:
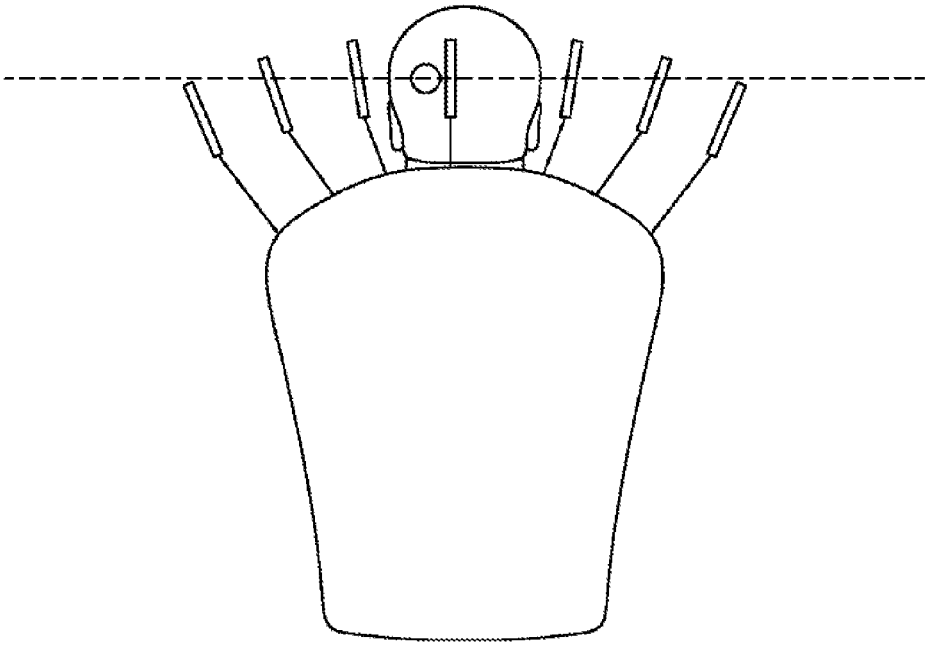
FIG. 2 shows a top view of a putter moving in an arc, and the face of the putter staying perpendicular to the arc.
Figure 3:
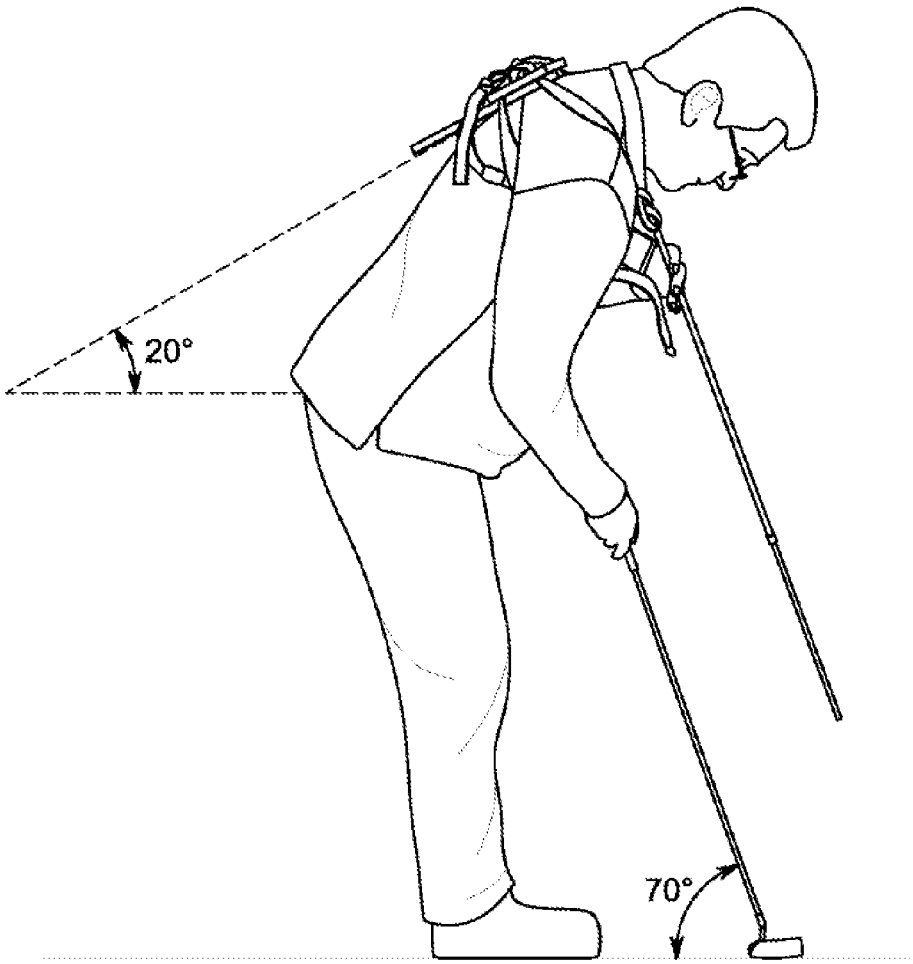
FIG. 3 shows a line diagram of a golfer in an ideal posture with the upper thoracic spine angle at a right angle to the putter shaft.
Figure 4:
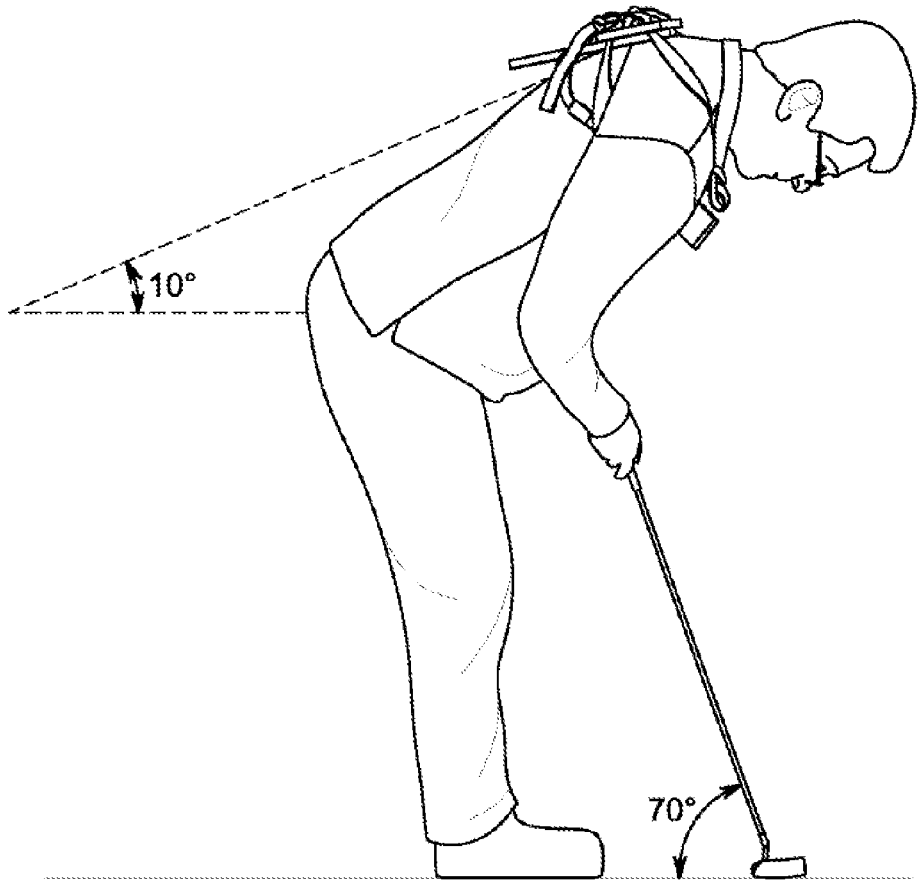
FIG. 4 shows a line diagram of a golfer with a spine angle too flat compared to the putter shaft.
Figure 5:
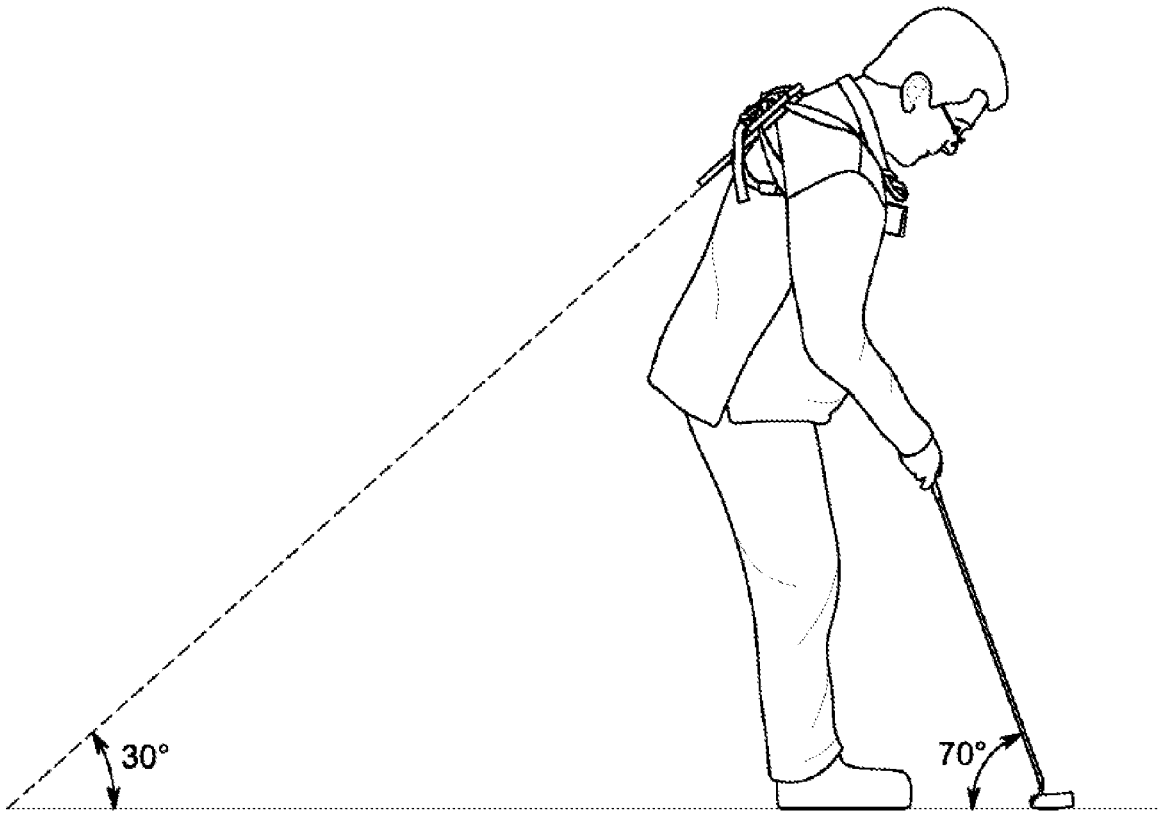
FIG. 5 shows a line diagram of a golfer with a spine angle too vertical compared to the putter shaft.

The first horizontal visual aid 700 is shown to be placed on the surface to which the player is practicing their stroke or rotation, such as the ground. In this instance, the first horizontal visual aid 700 is placed in a position that is parallel to the target line of the stroke, which is also represented in FIGS. 1-2 as the dotted line 20. It will be appreciated that the first horizontal visual aid 700 could be fabricated from a variety of different materials, which could be flexible or rigid, so long as it had the ability to form a substantially straight line on the surface on which it is to be placed. For example, the material may be an elongated metal or plastic tube or bar, but could in fact be a flexible material, such as a rope. Alternatively, it may be one or more lines drawn on the ground surface using a suitable marker. Plastic alignment sticks are readily available in the market and are widely used.

As the player sets up to practice their stroke and rotation using the apparatus and methods disclosed herein with the visual aids, a laser line of the one or more second lines of the light source when worn by the user is set up to be parallel to or substantially on top of the first horizontal visual aid 700. In this instance and during the stroke, correct thoracic spine rotation and movement would be indicated by the laser line following a path that is parallel to or on top of the visual aid 700 on the ground surface.

As is also shown in FIG. 9, a second vertical visual aid 702 is provided that is at an angle (A) in a transverse plane to that of the first horizontal visual aid 700. The vertical visual aid 702 can be manufactured from a variety of materials, which could be flexible or rigid, so long as it had the ability to form a substantially straight line on the surface on which it is to be placed. As is shown in the Figure, the visual aid 702 is supported against a wall or vertical surface 750. It will be appreciated that the second vertical visual aid 702 could be manufactured from a variant of materials, which could be flexible or rigid, so long as it had the ability to form a substantially straight line on the surface on which it is to be supported by.

When setting up the visual aid 702, the angle (A) should be substantially equal to the club shaft at address and would vary depending on the player's stance. In this regard, when the player makes the stroke and exhibits correct thoracic spine rotation, the laser line that follows the first horizontal visual aid 700 on the ground surface will continue to follow or be substantially parallel to the visual aid 702 that resets in a vertical plane. It should be noted that the vertical plane may in fact be an adjacent wall when the device is used indoors.

As described previously, the present disclosure relates primarily to a device that can be attached to the sternum of a player, whereby the movement of this device is very closely correlated with the movement of the thoracic spine. This is especially true for rotation. The spine rotates by means of a small change in orientation between each vertebral body. If a stroke is made in which the head and neck is kept still, then the uppermost thoracic spine must also remain in position, whilst it rotates on its axis. The facet joints in the thoracic spine and cervical spine are aligned in a way that permits rotation so it is this movement in the golf stroke that the device can highlight.

Figure 11:
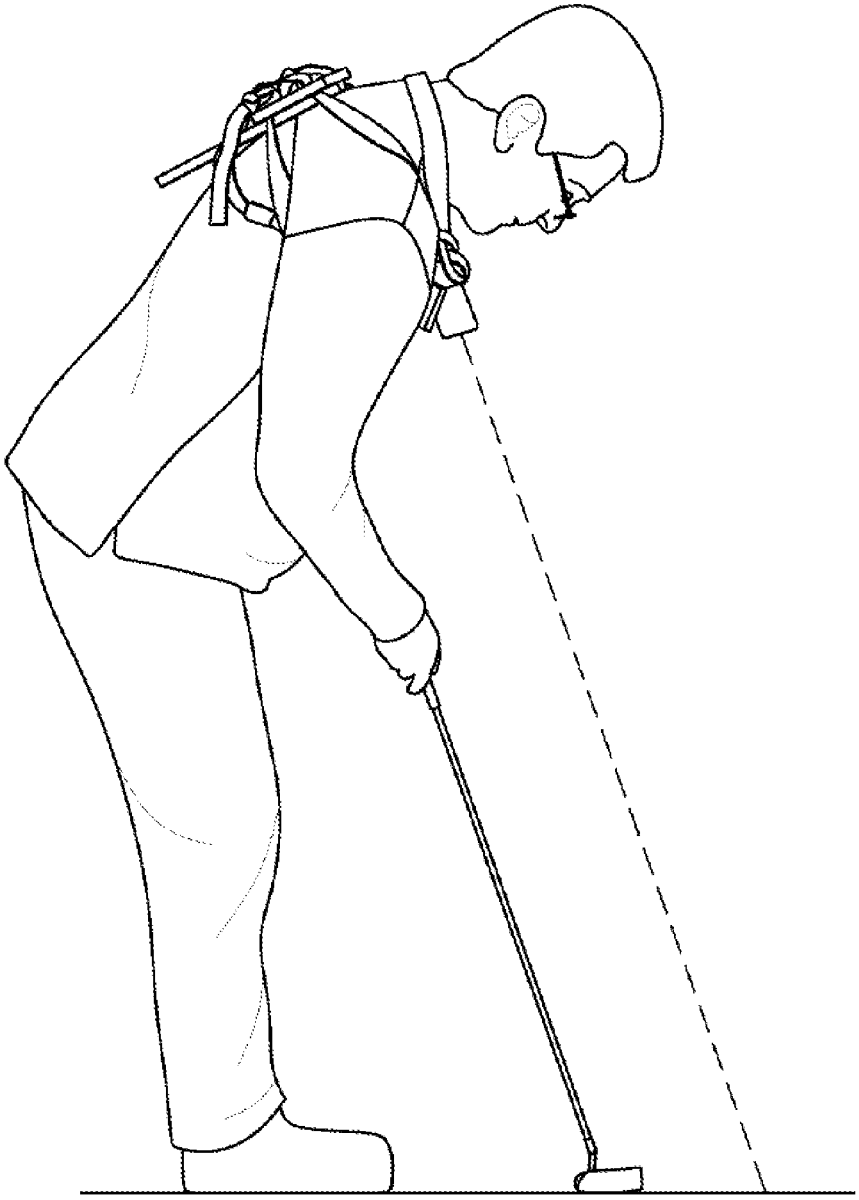
FIG. 11 is a line diagram showing a laser projecting light at right angles to the upper thoracic spine and parallel to the putter shaft.
Figure 12:
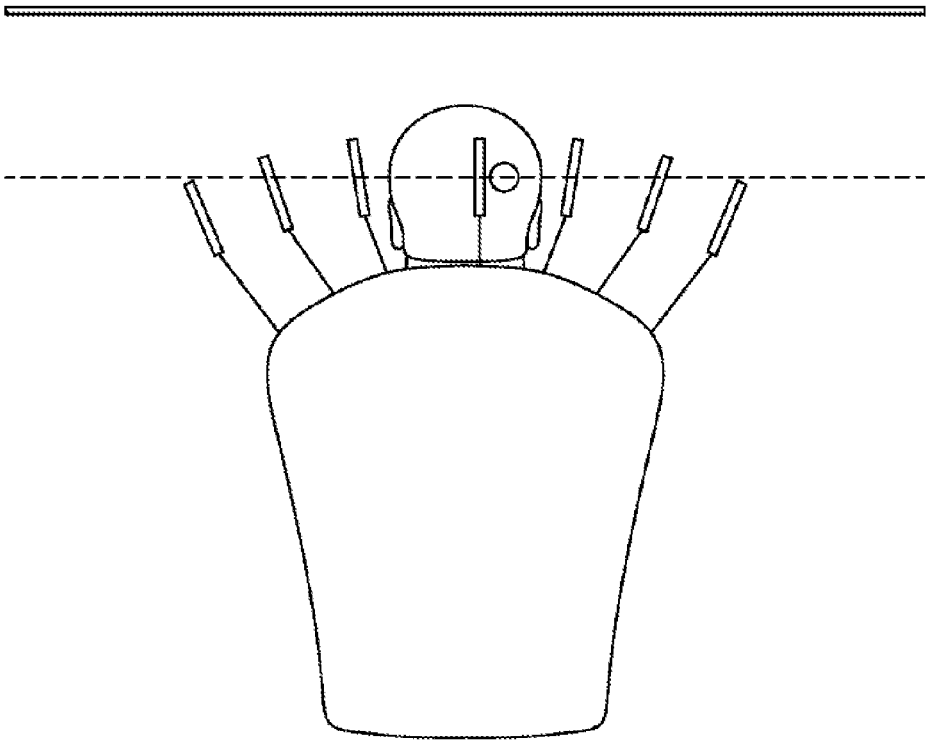
FIG. 12 is a diagram of practicing a putter stroke with an arcing path of the putter but the laser light from the thorax making a straight line on the ground parallel to the ball-target line.

FIG. 11 shows a representation of a golfer in posture holding a putter with a golf stroke training apparatus 10 affixed to the golfer's chest. The dotted line represents light emitted from the light source, which in this instance is a laser. The laser line is aligned to be perpendicular to the upper thoracic spine and parallel to the shaft of the putter. The lie angle of the putter is 70 degrees, and the laser line is incident upon the ground at 70 degrees, and the upper thoracic spine has a lie angle of 20 degrees, so this is the ideal matching of putter shaft plane and spine angle as previously described. If the thorax is rotated around this axis, the laser will make a line upon the ground, which will be a straight line parallel to the ball-target line but further away from the golfer. A putting stroke with or without a ball can be practiced, backwards and forwards, whilst observing the movement of the laser line. On level ground the line should remain straight, running always parallel to the ball-target line. This is shown in FIG. 12. The dotted line is the ball-to-target line, and the solid line is that on which the laser light should move.

It should be appreciated that the present disclosure can be used in a variety of golfing strokes. Short chip shots can be made with, for example, a wedge, using rotation around the spine and little arm or wrist action. A first laser line or point in the position parallel to the ball target line will show thoracic spine rotation. A second laser line will show how the arms are linked to the chest. It may be desirable for short shots to minimise the movements at sites such as the scapulae on the chest wall, or the joint of the upper arm with the scapulae. However, as the golf stroke becomes more forceful, it may be desired that there is movement at these areas in addition to the rotation of the chest around the upper spine. Observation of the pattern of movement of the second line or lines on the arms may provide useful information of the timing and extent of the arm swing in these strokes.

Specifically, the present disclosure advantageously contemplates analysis and improvement by training for all golf shots. For long shots requiring a full swing, the disclosure also provides and in some golfers, can preclude full use of both arms, but the disclosure can be used to practice the turning motion of the body, making swings with no arms, or using just the "trailing" arm, namely the right arm for a right-handed golfer, and a ball can be hit this way in practice. Correct body movements in these scenarios can be rehearsed as follows.

The golfer assumes the usual posture for a shot, with the laser set at 90 degrees to the spine, as has been described previously. Either a laser point or first or second lines can shine down upon the ground some distance away from the golfer, being closer the shorter the club and thus the more bent the posture.

If the golfer keeps the legs and pelvis very still and just rotates the thoracic spine, keeping a constant axis, the laser light incident upon the ground will move in a straight line staying parallel to the ball target line. Alternatively, if the golfer instead uses the legs to turn the pelvis, whilst allowing the torso to be passively turned and keeping the same height and same spinal axis, it is possible that a different pattern of line movement will be seen. For example, it may be that the laser line moves in an arc to the inside and more around the golfer. This possible difference in light movement pattern between coiling of the spine itself and the turning of the spine upon the pelvis, is because the pelvis is generally not able to be turned by the legs on an axis as steep as the spine.

In the downswing, similar patterns of light movement on the ground can be used to educate the golfer about the pattern of the torso movement.

It should be noted that the laser housing can be swivelled so that both laser lines move in the transverse or horizontal plane, and in this way both lines can be moved from the ground to be also displayed on a wall to either side of the golfer. The first line will run up the wall and be at 90 degrees to the second line, which will project onto the wall and mirror the angle of the upper spine on the wall. The pattern of movement of these lines can be observed in a similar way to when they are on the ground, but it may be that the human mind can relate better to the same data presented in a visually slightly different way.

Potentially many faults can be identified, and corrective movements practiced. For example, if in the downswing the hips make an incorrect move, this will likely result in the golfer being unable to make the correct thoracic movement, as will be evidenced by the golfer being unable to bring the laser light back along a certain path. Thus, the golfer can practice being able to make the laser line move in a certain way, and thus learn an appropriate pattern of body movement.

While throughout the detailed description some embodiments have been described with respect to the use of a golf club with the training apparatus. It is not a requirement and certainly in some embodiments the training apparatus can be used as a coaching aid without the user holding a golf club. In this manner, the present disclosure can be used to coach a player to correct rotation of their spine during a simulated stroke movement. The coaching device allows the user to visualise how the spine is moving and allows them real-time feedback to correct any deficiencies in the movement. The player, as has been described in preceding paragraphs, will monitor the path of the light source that emanates the ground as they make the rotational movement or other movement that may be required during a golf stroke.

Golf is a game in which the player stands side on or "square" to the direction in which he/she wants to propel the ball (commonly called the target line). Thus, knowing the orientation of the chest would be very useful information, but it is not easy to do without a visual aid as the golfer bends forward, mostly at the hip joints, when getting into posture for a shot. Also because of the mobility at many of the joints as described above, chest and upper spine alignment cannot be easily guided by shoulder alignment or alignment of the legs and pelvis. As such, the present disclosure provides a way a user can easily monitor their anatomical motion in real-time.

The present disclosure primarily provides a visual guide to allow the user to monitor spine rotation through making a stroke. However, as will be appreciated some strokes in the game of golf may in fact require some tilt of the spine away from the target. This is commonly the case when the ball is "teed up" and the golfer is trying to hit upwards to launch a ball higher trajectory for maximum distance. As such, a vital part of getting into the ideal posture or set up for any golf shot is to know the orientation of the upper chest and upper spine prior to making the shot. If the pivot point or axis of rotation is not in the correct position it is more difficult to make a correct move.

As the training device disclosed herein sits in a predetermined and fixed position on the central bone of the front of the chest, the sternum, the one or more laser lines produced by the device can show the relative alignment of the sternum, ribcage, and upper thoracic spine. This will be explained in further detail below with respect to a use of the training device, whereby for ease of reference the device will be exemplified where the light source (i.e., laser) emits two distinct lines on the ground in the substantially the shape of a T. As the tilt and rotation of the laser relative to the housing is made possible via the attachment means, the player uses this adjustment to check and calibrate the laser lines that emanate prior to use. In this regard, for ease of use it is preferable that this step is done facing up to a vertical surface (i.e., a wall or the like). The user checks that when in an upright stance (i.e., with no spine bend) the first laser line is substantially horizontal and the second line is substantially vertical.

Once the user has fitted the device and checked laser adjustment as described in the preceding paragraph, they move to bend at the waist or at the lower spine so that the laser lines formed by the light source appear on the ground. If the spine and chest remain square to the target, the first laser line will be parallel to the ball-target line (i.e., the "target line"). The second laser line formed by the training device will be central beneath the upper spine. Given this, it is relatively simple to see what happens if the upper chest alignment is not square to the target with the use. The first laser will indicate either an aim or a tilt of the upper spine to that side. The position of the second laser line varies with either aim or tilt. It is central if just the aim is to one side and angled away from the midline if the upper chest is tilted.

As such, it will be appreciated that not only does the training apparatus allow a user to monitor their movement during a stroke, but it allows a person to coach the set up for the perfect stroke and aim.

Figure 15:
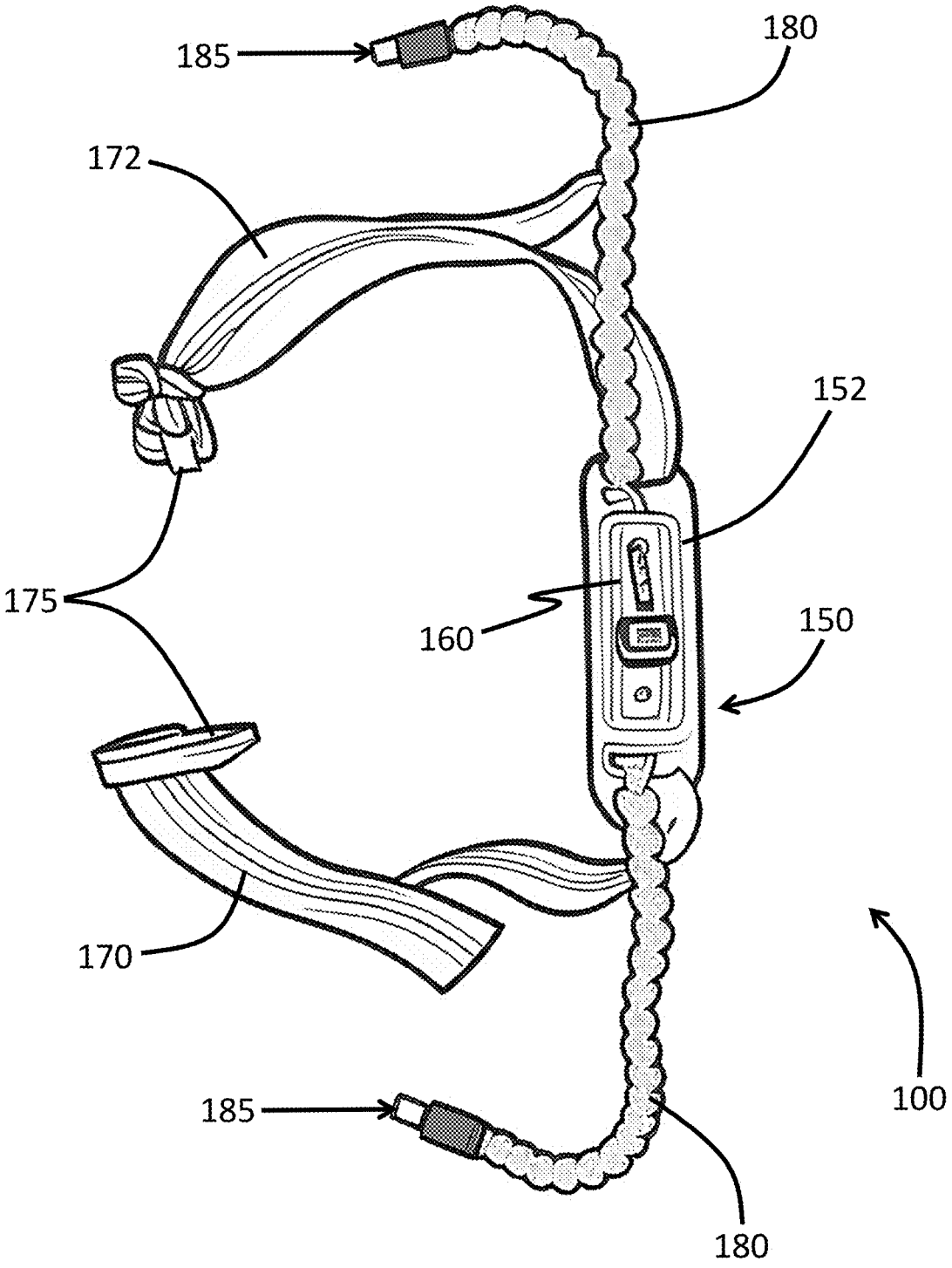
FIG. 15 shows a waist mounted training device according to another embodiment.
Figure 16:
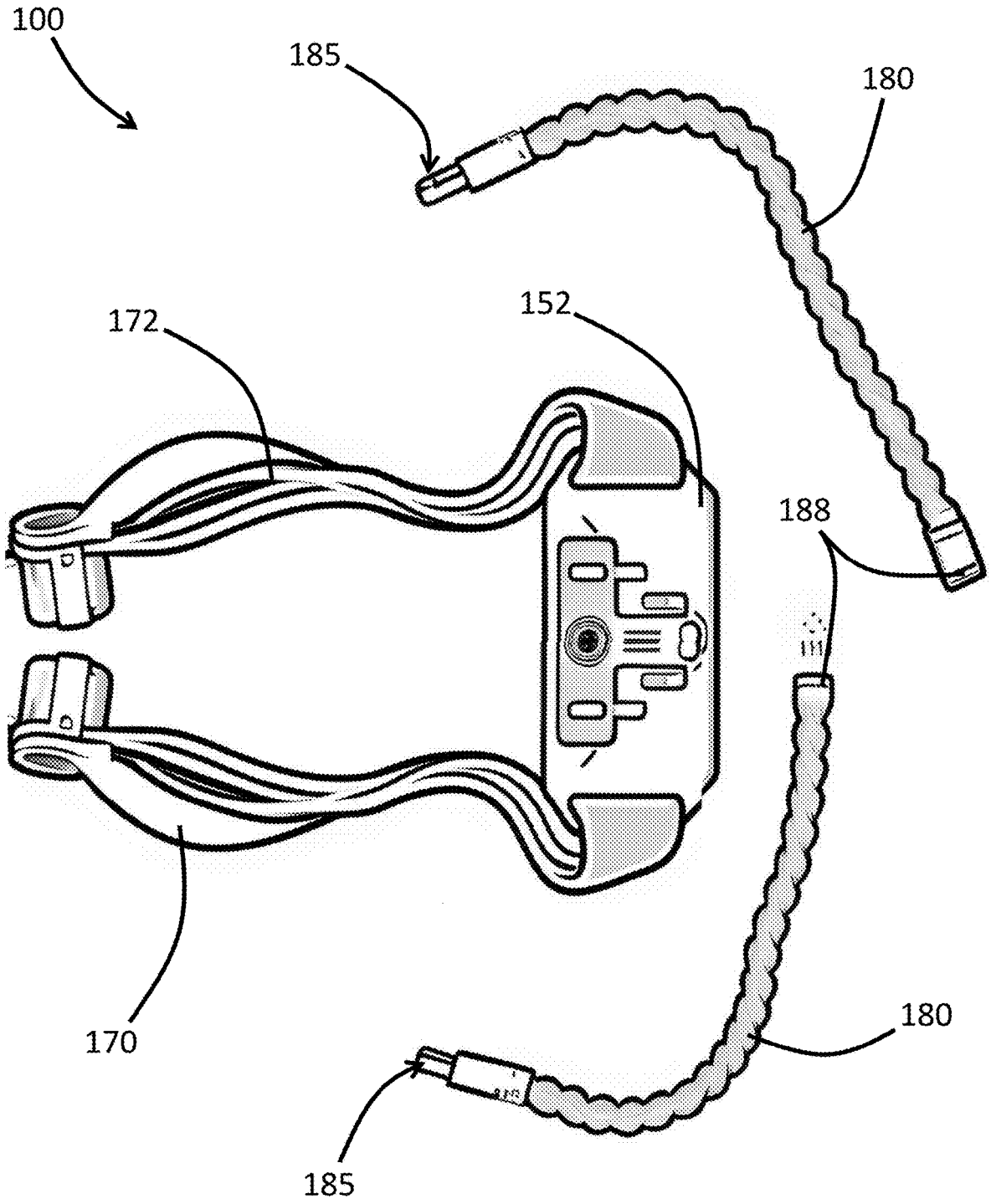
FIG. 16 shows the waist mounted training device of FIG. 15 with arms detached.
Figure 17:
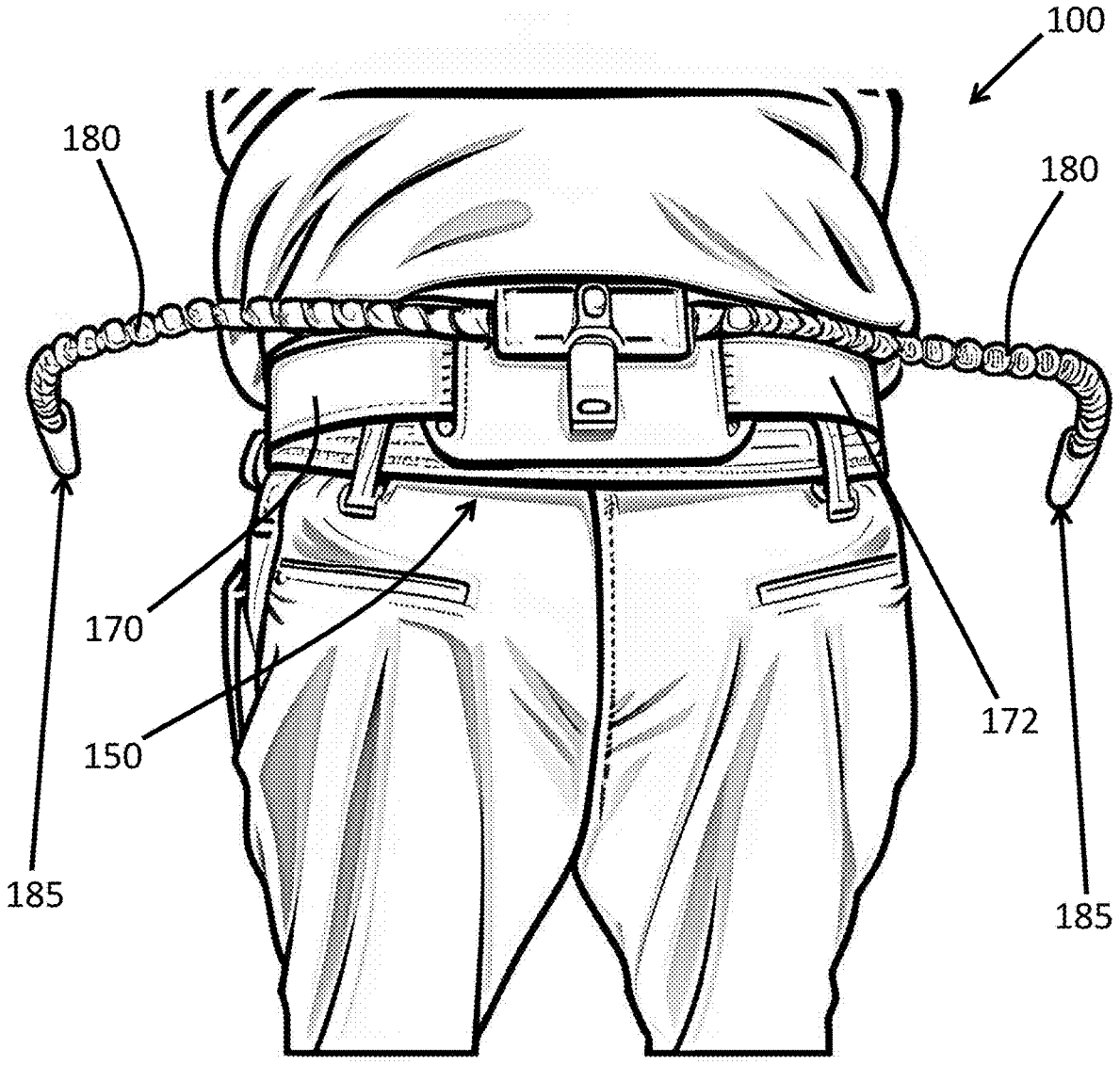
FIG. 17 is a rear view of a user fitted with the waist mounted training device according to FIG. 15.

Turning now to FIGS. 15 to 17, a golf training apparatus 100 is illustrated, according to some embodiments. The golf training apparatus 100 has one or more light sources 185 adjustably mounted on a device intended to be secured about the waist of the player.

In some embodiments, the apparatus is secured around the waist of the player 1 by means of belt straps 170, 172 that may be coupled together by a buckle or other releasable fastening. The belt can be adjusted to accommodate a variety of waist shapes and sizes. It should be noted that while a belt is preferred, those skilled in the art would appreciate that other support mechanisms for the light source(s) 185 could be used without departing from the present disclosure. These include, but are not limited to, a waist harness, a full body harness, or whereby the light source is attached to an item of clothing worn by the player via a suitable attachment means, in accordance with some embodiments. A full body harness might be the preferred option when an if the waist training apparatus is used in conjunction with an additional device attached about the players chest regions, which will be described in further detail with respect to the system in another embodiment.

Importantly, while the mechanism as to how the apparatus 100 is secured about the waist of the player is not overly limited, it should be appreciated that the light source(s) should be secured in such a way by which it provides an indication of the orientation and movement of the pelvis. As such, it is envisaged that the attachment provides a rigid coupling whereby the light source moves in conjunction with any pelvis movement the player may make during a stroke.

As seen best in FIGS. 15 and 17, each light source 185 is on the end of an adjustable arm 180 which extends from an attachment point provided on a housing 160. The housing 160 is mounted on a rigid plate 152 which together comprise a rear mounting structure 150. The opposing second end of each elongated guide arm 180 is removably attached to the housing 160 (see FIG. 16 showing arms 180 detached). The sides of the rigid plate 152 are have the respective belt straps 170, 172 attached thereto. The structure and type of the attachment means for both the first and second ends of the elongated guide arm 180, which provides attachment points for the light source and rigid plate, respectively, is not overly limited. In some embodiments, however, the attachment means is a screw type connection or a clamping mechanism. Other suitable attachment means would include, but not be limited to, magnets or Velcro™.

The placement of the belt around the user can be varied. However, the belt preferably is worn, in use, at a position that is beneath the iliac crests of the person wearing the device. In this manner, it is preferred that the rigid plate 152 of the mounting structure 150 rests directly over the sacro-iliac area of the posterior part of the pelvis. When worn, the rigid plate rests against the lower back of the player.

Given that each light source 185 is attached via a respective elongated guide arm 180 to the mounting structure 150 that rests on the back of the user when in use, this ensures visibility of the lines and/or patterns of light produced by the light sources 185 and permits the user to adjust and set how the light is visible to the player when making a stroke. Importantly, as the elongated guide arm 180 allows the light source to project from the side of the player and move in conjunction with waist movement, at this position it is less likely to be obscured by the arms of the user or hindered by the action of bending over at the waist while the player makes the stroke.

Each light source 185 is preferably a collimated light source such as a laser that produces lines and/or linear patterns. The or each laser device may be contained in the end of the elongate guide arm(s) 180, or may be contained in the housing 160 and conducted through a flexible waveguide or conduit extending through the arm 180. While a laser is preferred as it offers good visibility in various light conditions, the type of light source used in the present disclosure is not overly limited and could be any light source that can produce a single point, pattern or one or more lines on the ground surface near the players club or putter head, or on an adjacent vertical surface. To enhance interpretation, a pattern or one or more lines would be preferred.

Given that in some embodiments, the light source is a laser light, as mentioned the light source could be housed in the support structure 150 rather than at the end of the elongated guide arm 180. In some embodiments, the elongated guide arm(s) 180 would be configured to conduct the light source with a sufficient intensity to emanate from the terminal end thereof. In this regard, the elongated guide arms could be structured to include a waveguide, such as an optic fibre, that conducts light via total internal reflection to the end 185.

In use, the light source of the training apparatus 100 projects light onto the ground or an adjacent vertical surface. Observation of the way the laser light moves on the observable surface can then provide information about how the pelvis and thus the base of the spine is moving. Alternatively, the apparatus can also provide useful information when the lower body is recommended not to move (i.e., when putting).

It is preferable that the light source produces a pattern that is visible to the player in all indoor and some outdoor light conditions, and thus has sufficient intensity. The pattern produced by the laser could be a grid or cross, whereby when the golfer stands "square" to the target line, the laser is configured to produce a line on the ground that is substantially along or parallel to the ball-to-target line. In some embodiments, one or more first lines of the grid or cross pattern produced by the laser on the ground surface would be aligned substantially parallel to the ball-to-target line, which is commonly referred to as the "target line." Consequently, one or more second lines of the grid or cross pattern produced by the laser on an observable surface would be equal to or substantially parallel to the club face, or in other words, transverse to the one or more first lines.

While the training apparatus 100 described in the preceding paragraphs can provide useful information while making a golf stroke about the orientation and movement of the pelvis, in some embodiments it is intended to be used in conjunction with the earlier described device 10 attached to the upper portion of the body of the player, that relates to orientation and movement of the thoracic spine.

Figure 18:
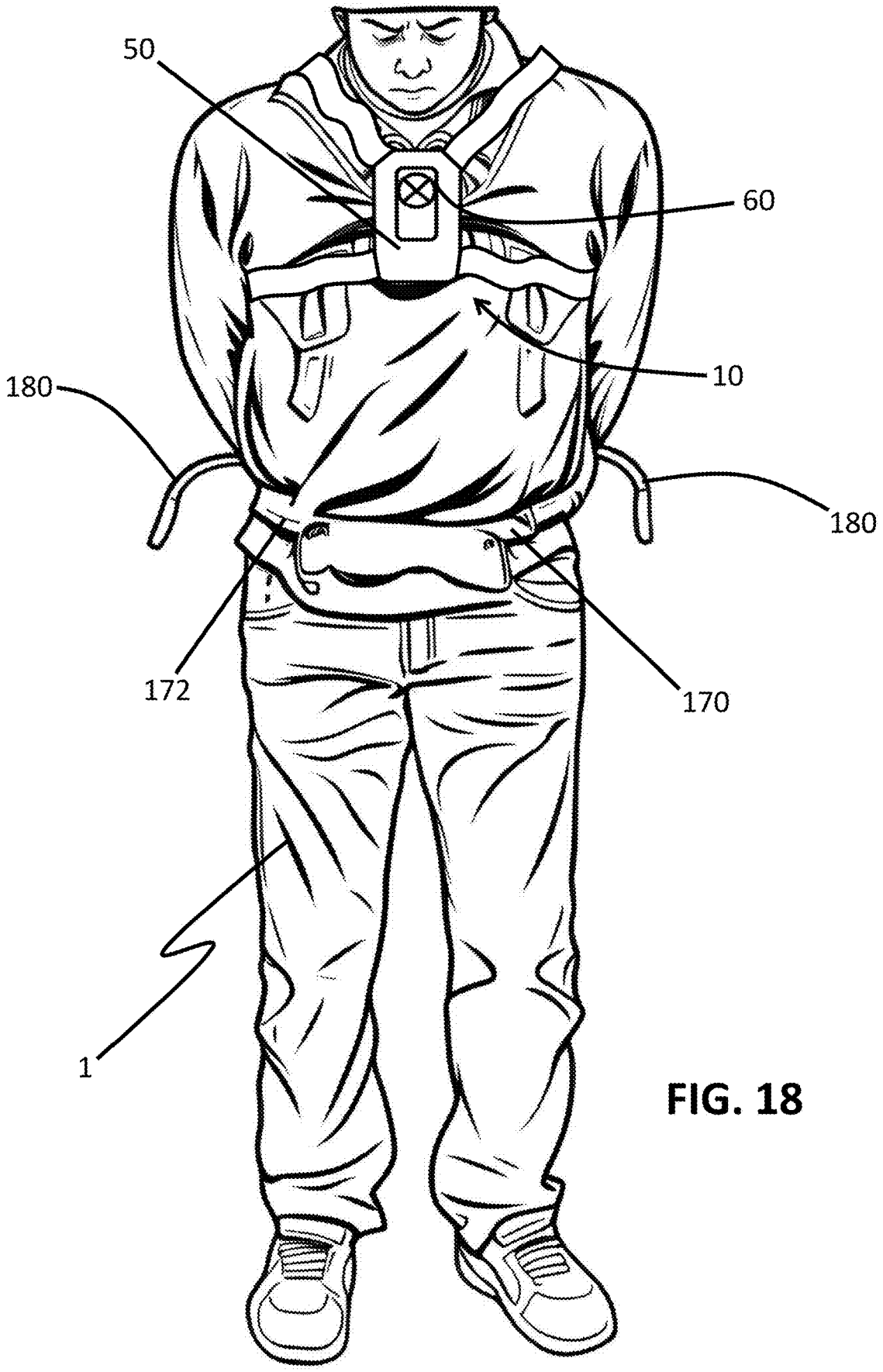
FIGS. 18 and 19 are front and rear views, respectively, of a user fitted with both chest mounted and waist mounted training devices according to some embodiments.
Figure 19:
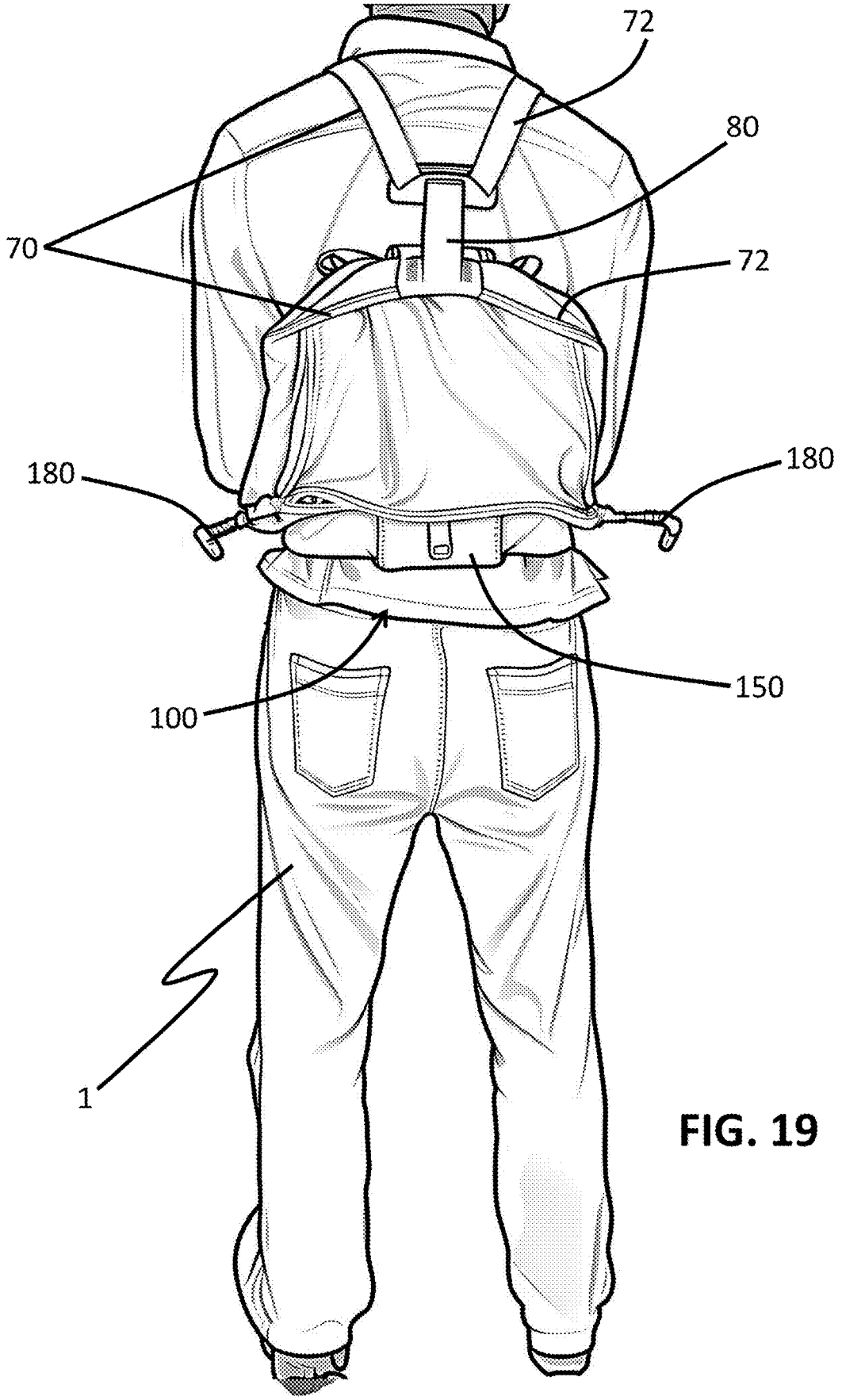

As such, FIGS. 18 and 19 show a player 1 fitted with both a chest mounted device 10 and a waist mounted device 100. In this regard, the waist mounted device 100 is as described hereinabove. As such, the device 100 is adapted to be secured about a player's waist and in use provides a visual indication of the orientation and movement of the pelvis. The chest mounted device 10 of the training system is adapted to be secured about the anterior aspect of a player's thorax and thus provides a visual indication of the orientation and movement of the player's thorax about the axis of the thoracic spine.

The chest mounted device 10 comprises a light source support member 50 that is adapted to be supported about the players shoulder region by one or more shoulder straps 70, 72. The shoulder straps secure the support member around the players shoulder region, whereby the support member rests substantially over the midline of the sternum. The shoulder straps run posteriorly where they also connect with a back plate 80 which is to be positioned in the midline of the back, over the spines of the upper thoracic vertebrae. In use the back plate of the device 10 is held tightly against the skin of the upper back and preferably in the midline between the scapulae. The back plate overlies the spines of approximately the 2nd to 7th thoracic vertebrae, so the plate is parallel to these vertebral bodies.

While it is illustrated that shoulder straps and a back plate can be used to provide adequate support for the device 10, one or more chest straps could alternatively be used to achieve the same purpose. It should be appreciated, however, that the support member 50 when in use should lie in a region that follows the rotation of the player's thorax about the axis of the thoracic spine when making a stroke.

In some embodiments, the wearable support member of the chest mounted device 10 could be attached to a specially designed garment that is worn by the player, such as a shirt, vest, or holster. In some embodiments, it is envisaged that the support member 50 would be secured to the front of the garment via a suitable attachment means. Alternatively, the support member may be incorporated as part of the wearable garment itself as a single wearable item or be attached to the player's skin directly by using a suitable connection. Lastly, the first and second device could in some embodiments be secured at the relevant anatomical location by the use of a combined full body harness with suitable attachment points for each of the respective devices.

Figure 20:
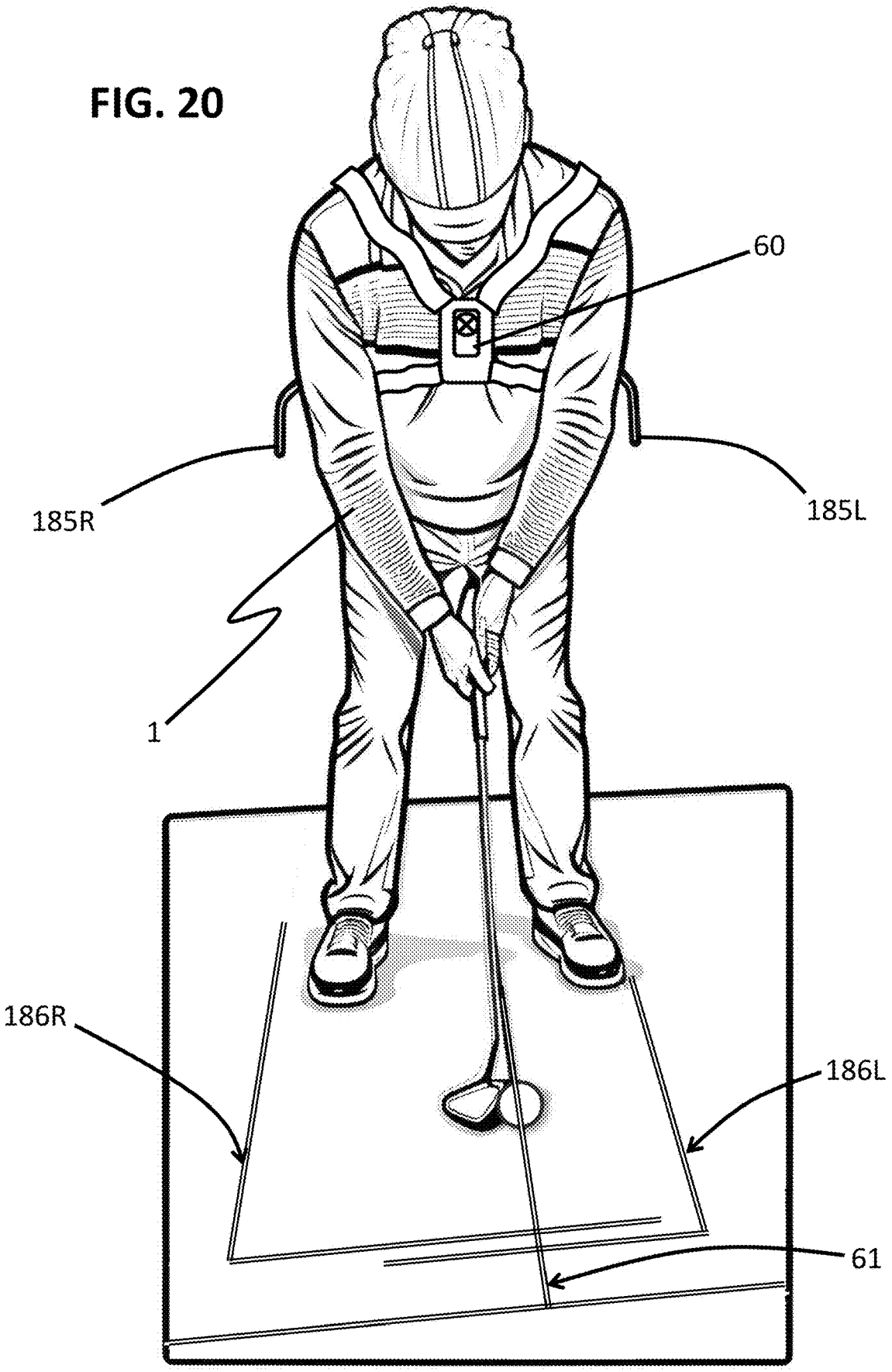
FIG. 20 illustrates projection of illuminated guide lines or patterns produced by chest mounted and waist mounted training devices onto a horizontal ground surface.
Figure 21:
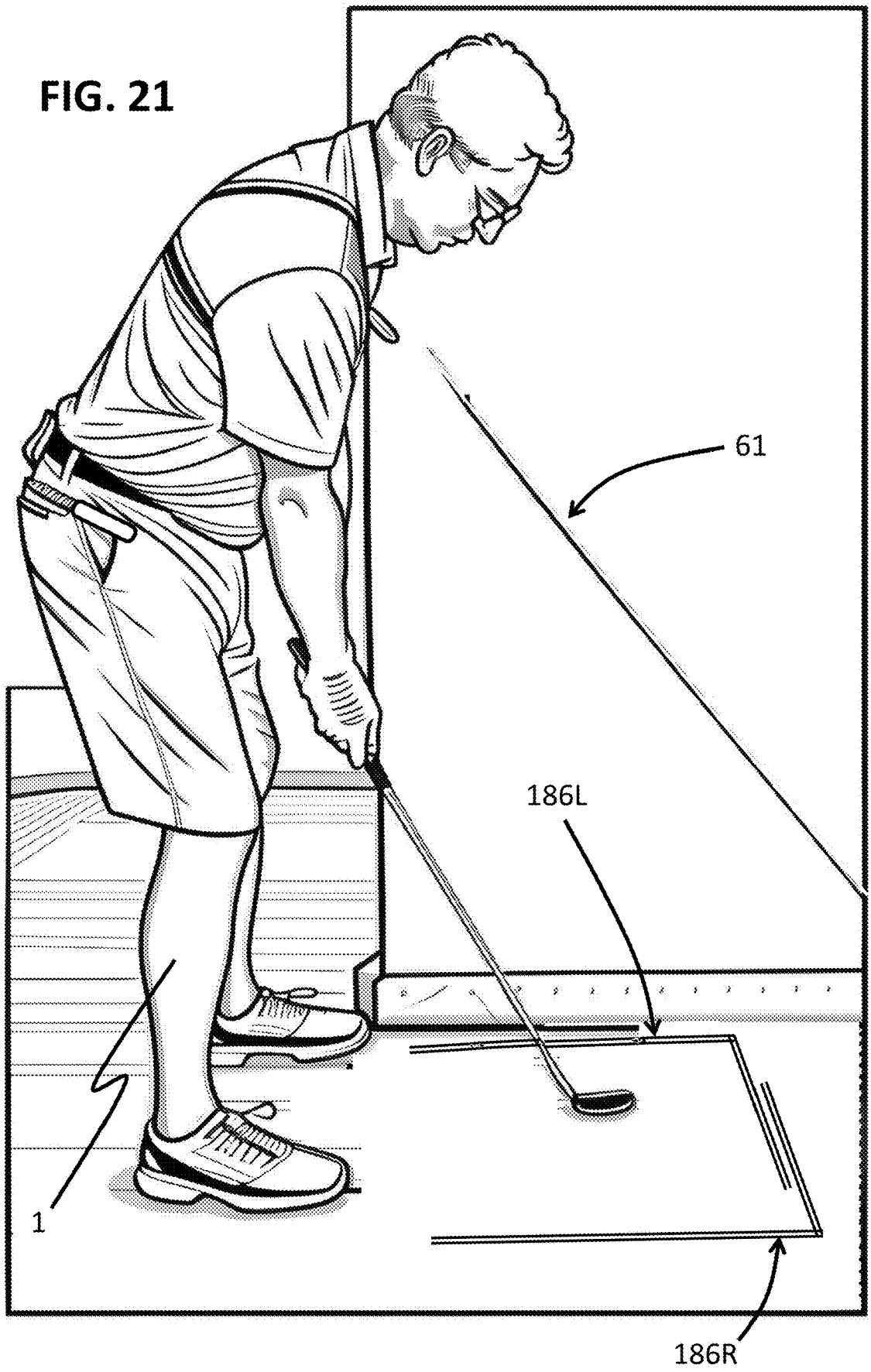
FIG. 21 illustrates projection of illuminated guide lines or patterns produced by chest mounted and waist mounted training devices onto horizontal and vertical surfaces.

In use and by attaching the two devices 10, 100 to the respective parts of the body which represent the movement of both the top and bottom parts of the spine, significant information can be gathered about, for example, how the spine is coiled and uncoiled during a golf stroke, and the sequence of such movements. As each of the devices both emit one or more laser lines onto the ground or adjacent surface, it is preferable that the colour of the laser light emitted from each device is different. For instance, referring to FIGS. 20 and 21, the one or more laser lines 186L, 186R from the left (185L) and right (185R) side light sources of the waist mounted device 100 may be red, while the one or more laser lines 61 from the from the light source 60 of the chest mounted device may be green in colour.

It will be appreciated that the part of the spine within the upper chest is one of the most pivotal areas to monitor in the game of golf, as this is the level where the arms are attached. As such, with the upper device 10 being secured about the anterior aspect of a player's thorax, the movement of this part of the spine can be assessed. The device 10 can be adjusted so that it can be estimated that a laser line projects from the anterior surface of the chest at 90 degrees from the upper thoracic spine. This improves the ability to interpret how the movement of the laser lines on adjacent surfaces relate to the movement of the upper thoracic spine. However, by itself the chest device 10 provides little information about lower body movement and/or rotation during a stroke except for the way in which such movements affect the upper body.

To provide this missing information, the lower device 100 is secured to move with the player's pelvis. Note that in contrast to the chest, it is not possible to know with much certainty what is the geometric relationship between the pelvis and the spine. It is possible to know if the pelvis is "square" to the target, but the movement of laser lines is difficult to interpret if it is not known at what angle the laser lines are set with respect to the spine. However, one or more laser lines can be projected from the pelvis onto adjacent observable surfaces at the same time and in close proximity to those from the chest. The laser lines emitted from the first and second devices can be adjusted to be parallel to each other at a suitable distance apart. By this means, analysis and training of body movements in golf are improved.

In practice, the golfer takes position for a golf shot, and initially sets up the chest device 10. The first laser line emitted from the device 10 should be adjusted to be at approximately 90 degrees to the upper thoracic spine. This first line will be substantially parallel to the ball "target line" on the ground in front of the golfer. Whilst remaining at approximately 90 degrees to the upper thoracic spine, the laser can be swivelled to either side. Thus, as well as being visible on the ground, the first and second laser lines can also be seen on a wall to either side. More usually the backswing side is preferred. On a vertical wall directly behind the target line, the laser lines will now be at 90 degrees to each other, and the second laser line from the chest device will indicate the upper spine angle as the golfer is viewed from the side.

Subsequently to this set up of the chest mounted device 10, the waist mounted device 100 and the laser lines emitted therefrom will be set up. In this regard, a first laser line emitted from the device 100 will be set such that it is at the same angle on the wall as the first laser line emitted from the chest device 10. This is a key point—with this configuration, many elements of body movement in the golf stroke can be analysed and trained.

For example, when the golfer uses legs to turn the pelvis, it can be seen if the pelvis can be turned on the same plane as the upper spine. To do this, as above, the first lines from both devices are set up to be parallel on a wall behind the golfer by adjusting the line from the waist device to match that from the chest. Then when the golfer makes a backswing, the lines are observed, and a theoretical ideal would be that they stay parallel and on the same plane as the first line from the chest laser. Whether this can be achieved will depend on posture and mobility especially of the hip joints. Elite golfers often have a wide range of movement and considerable strength around the hip joint. If the lower spine can be moved by the legs in the same plane as the upper spine, the spine should be coiled with little bending forces.

It can also be observed how much "hip turn" is possible with varying degrees of tilt, by observing how far the lines from the first device can be moved, and at what angle. If the golfer initially sets up with a straight spine, and during the stroke the angles of lines from the two devices diverge, it can be inferred that the spine is bending.

The extent of spine coil in a golf stroke can be determined by observing the difference in movement of the one or more laser lines produced by each of the first and second devices, likely best shown by observation of the second laser lines from each device. The laser lines projected from the second device (i.e., chest device) should move in total more than the one or more laser lines projected from the first device (i.e., the waist device), as movement of the chest should be superimposed upon movement of the pelvis. This would especially be the case in a full golf swing.

The sequence of movements is of major importance in golf, as well as the overall range and direction of movement. Methods are not readily available for coaches or individuals to analyse how the spine is coiled and then is uncoiled, even though this is likely to be vitally important. In a full golf swing, there is a strong view that the ideal sequence of movement in the downswing is that the lower body should move before the upper. This most likely implies that the pelvis should be turned back before the chest, and this is very easily analysed and trained by observing the sequence of the one or more laser lines observed from the first and second devices of the system. In the downswing, the laser lines from the chest device should not be moved before the lines from the waist device. Movement of the one or more laser lines from the waist device may occur somewhat independently of the lines from the chest at the very start of the downswing motion, as this may result in a little extra coiling of the spine which might not be considered a disadvantage. However, it can easily be envisaged in mechanical terms how an early uncoiling of the spine in the downswing (the chest moving too much relative to the waist-seen in movement of the respective laser lines) might result in an inefficient delivery of power in a later stage of the golf stroke.

However, it will be appreciated that there may be many variations in certain other golf shots, for example in some short shots, control is paramount. Body movements are less than in a full swing, and laser lines from both devices are usually easily seen on the ground near club and ball. In putting it is suggested that all the motion is generated by movement of the chest, so lines from the first device should be static whilst the lines from the second device move appropriately. In some other short shot such as a chip or pitch, it is possible that the backswing might involve mostly movement of lines from the chest laser, reflecting a coiling of the spine, and then in the downswing the spine might be kept coiled so that the main body movement might be from leg action—in which case both sets of laser lines might move quite synchronously.

As disclosed in the specification of international patent application no. PCT/AU2022/050168 and described above, a training apparatus may comprise a light source attached to the chest of the golfer. Light from the device shines towards a visible surface whereby observation of the light provides information about the movement of the chest. It can be deduced how the golfer generates movement of the club, with respect to elements such as rotation around the spine or movement at other joints such as shoulders or hands. The present disclosure is particularly useful for putting but can also guide thoracic movement in other golf strokes.

The rotation of the body is a central part of almost every golf stroke, whereby the spine must function as an axis to a very large extent. However, due to the human anatomy, the spine is not just a simple axis, it is also able to coil upon itself as each vertebral body has a little movement one upon the other. As well as this coiling or rotation, the spine can bend.

During a putting stroke, and perhaps some other short shots requiring little force, the lower part of the spine is kept very still and only the upper part of the spine is moved. A simple pivot around the upper thoracic spine seems to be the movement pattern of the best exponents of this part of the game. The body beneath the upper chest both supports and assists the pivoting of the upper chest around the spine, whereby this only requires a small amount of coil within the spine However, as more power is required for longer shots, the golfer makes use of more body rotation, such that the lower body becomes more active. In golfing parlance, the legs become active and there is a hip turn, but this might more correctly be described as the legs are being used to move the pelvis, acting via the hip joint on each side. As the base of the spine is joined to the pelvis via a relatively immobile joint, when the pelvis is moved, the base of the spine is moved.

Considering the above, it would be worthwhile to attempt to determine how the pelvis is moved in the golf swing, especially in relation to the upper part of the spine. Then it would be possible to deduce how the spine is coiled or rotated. As well as the degree of coil, the sequence of actions that result in the coiling and uncoiling is especially important. It should also be possible to infer whether there is much bending of the spine.

While the above has been disclosed with reference to a best mode of operation, there is likely much variation in this area, even within elite golfers. It is likely that golf coaches and individuals will be better able to ascertain the most suitable patterns of movement by means of the instantaneous feedback provided by one or more laser lines observed from the first and second devices of the system. During practice the laser lines can be observed, so that the ideal movement can be better learnt and committed to "muscle memory."

Throughout this specification and claims which follow, unless the context requires otherwise, the word "comprise," and variations such as "comprises" or "comprising," will be understood to imply the inclusion of a stated integer or group of integers or steps but not the exclusion of any other integer or group of integers. As used herein and unless otherwise stated, the term "approximately" means±20%.

Persons skilled in the art will appreciate that numerous variations and modifications will become apparent. All such variations and modifications which become apparent to persons skilled in the art, should be considered to fall within the spirit and scope that the disclosure.

The invention claimed is:

1. A training apparatus comprising a support member with securing means adapted to be secured about an anterior aspect of a player's thorax, and a light source configured to provide a visual indication of an orientation of the player's thorax and rotation of the thorax about an axis of a player's thoracic spine during movement while making a real or simulated golf stroke;

wherein the light source comprises a collimated laser configured to project an alignment pattern onto a ground and/or wall surface in front of the player, in use; and wherein the alignment pattern comprises:

(i) at least one first laser line alignable with an intended target line; and (ii) at least one second laser line extending transverse to the at least one first laser line;

wherein the at least one first and second laser lines of the alignment pattern form a T-shaped pattern.

2. The training apparatus of claim 1, wherein the alignment pattern is projected onto the surface adjacent or proximal to the club head of a golf club held by the player during the stroke.

3. The training apparatus of claim 1, wherein the support member comprises a light source attachment means, and wherein the attachment means includes an adjustment means adapted to alter the angle and/or orientation of the alignment pattern projected from the light source, and wherein the adjustment means is adapted to alter the angle of the projected alignment pattern about the player's midline.

4. The training apparatus of claim 3, wherein the apparatus further comprises one or more shoulder straps, the shoulder straps adapted to be secured to the support member to secure the support member about the shoulders of the player, wherein when the shoulder straps are, in use, worn by the player and are attached to the support member, the support member rests substantially over a midline of a player's sternum.

5. The training apparatus of claim 4, wherein the shoulder straps run posteriorly and are attached to a back plate positioned in a midline of a player's back.

6. The training apparatus of claim 3, wherein the support member is configured to secure the light source directly to a player's body.

7. The golf training apparatus of claim 1, further comprising one or more flexible elongated guide arms attached to a mounting structure and adapted to project the light source from an end thereof.

8. The golf training apparatus of claim 7, wherein the one or more a flexible elongated guide arms comprises adjustment means adapted to alter the angle and/or orientation of the alignment pattern projected from the light source.

9. A golf training apparatus comprising: a support member with securing means adapted to be secured about a player's waist to fix the support member, in use, in relation to the player's pelvis, and a light source configured to provide a visual indication of the orientation of the player's pelvis during movement while making a real or simulated golf stroke;

wherein the light source comprises a collimated laser configured to project an alignment pattern onto a ground and/or wall surface in front of the player, in use; and wherein the alignment pattern comprises:

(i) at least one first laser line alignable with an intended target line; and (ii) at least one second laser line extending transverse to the at least one first laser line;

wherein the at least one first and second laser lines of the alignment pattern form a T-shaped pattern.

10. The golf training apparatus of claim 9, wherein the light source is attached to an adjustable belt, the belt being secured around the waist at a position preferably below a player's iliac crests.

11. The golf training apparatus of claim 10, wherein the support member comprises a rigid plate that is attached to either end of the adjustable belt, wherein in use the rigid plate rests directly over a sacro-iliac area of a posterior part of a player's pelvis.

12. The golf training apparatus of claim 11, wherein the rigid plate is part of a mounting structure adapted to secure the light source to the player by means of the belt.

13. A golf training system, comprising:

a first device comprising a golf training apparatus according to claim 9, in use secured about a player's waist, the first device projecting a first alignment pattern; and a second device comprising a training apparatus according to claim 1, in use secured about an anterior aspect of the player's thorax, the second device projecting a second alignment pattern, wherein during a real or simulated golf stroke the first alignment pattern provides a visual indication of an orientation and movement of a player's pelvis and wherein the second alignment pattern concurrently provides a visual indication of orientation and movement of the player's thorax about the thoracic spine.

14. The system of claim 13, wherein the collimated lasers of the first and second devices are different colours.

* * * * *